US009517819B2

(12) United States Patent
Souter

(10) Patent No.: US 9,517,819 B2
(45) **Date of Patent: *Dec. 13, 2016**

(54) APPARATUS FOR WALKING AND RESTING UPON THE WATER WITH IMPROVED WALKING STABILITY

(71) Applicant: Kelly K. Souter, Ogden, UT (US)

(72) Inventor: Kelly K. Souter, Ogden, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/693,462

(22) Filed: Apr. 22, 2015

(65) Prior Publication Data

US 2015/0225046 A1 Aug. 13, 2015

Related U.S. Application Data

(63) Continuation-in-part of application No. 14/167,438, filed on Jan. 29, 2014, now Pat. No. 9,290,244, which is a continuation-in-part of application No. 12/930,647, filed on Jan. 13, 2011, now Pat. No. 8,641,465.

(51) Int. Cl.
*B63B 35/83* (2006.01)
*B63B 7/08* (2006.01)

(52) U.S. Cl.
CPC ..... *B63B 35/83* (2013.01); *B63B 7/08* (2013.01); *B63B 7/085* (2013.01)

(58) Field of Classification Search
CPC ..... B63B 35/83; B63B 7/085; B63B 35/34
USPC ..... 441/76, 77, 78
See application file for complete search history.

(56) References Cited

U.S. PATENT DOCUMENTS

| | | | | |
|---|---|---|---|---|
| 1,533,023 A | | 4/1925 | Meredith | |
| 3,108,296 A | * | 10/1963 | Smith | B63B 35/83 114/140 |
| 3,473,502 A | | 10/1969 | Wittkamp | |
| 3,750,203 A | | 8/1973 | Ceccato | |
| 3,777,324 A | | 12/1973 | Jenkins | |

(Continued)

FOREIGN PATENT DOCUMENTS

| | | |
|---|---|---|
| CA | 736381 | 6/1966 |
| DE | 3423422 | 1/1986 |
| WO | 2008/148907 | 12/2008 |

OTHER PUBLICATIONS

U.S. Appl. No. 12/930,647, Dec. 10, 2012, Office Action.

(Continued)

*Primary Examiner* — Andrew Polay
(74) *Attorney, Agent, or Firm* — Workman Nydegger

(57) ABSTRACT

A water walking apparatus having two inflatable pontoons, each with respective holes in their top surfaces for a footwell. A platform support may expand and contract when in use so as to accommodate variable spacing between the pontoons. The platform support may include curved saddle, which straddles over the curved outer surface of a pontoon, securing the platform support to the pontoons. A platform upon which a user may sit may be connected to the platform support by a neck received into a hole in the bottom of the platform. The platform may include a backrest member, and a strap that may serve as a ladder step when the backrest member is rotated rearwardly and down, into the water to allow a user to step on the continuous strap and climb up onto the platform.

13 Claims, 21 Drawing Sheets

(56) References Cited

U.S. PATENT DOCUMENTS

| | | | | |
|---|---|---|---|---|
| 4,034,430 | A * | 7/1977 | Joyce | B63B 35/85 441/77 |
| 4,129,912 | A | 12/1978 | Robinson | |
| 4,915,047 | A | 4/1990 | Lord et al. | |
| 4,952,184 | A | 8/1990 | Graziano | |
| 5,080,621 | A | 1/1992 | Nayes | |
| 5,120,249 | A | 6/1992 | Fonda | |
| 5,421,759 | A | 6/1995 | Morin | |
| 5,540,178 | A | 7/1996 | Damron | |
| 5,697,822 | A | 12/1997 | Souter | |
| 6,131,532 | A | 10/2000 | Winner et al. | |
| 6,223,678 | B1 | 5/2001 | Haller et al. | |
| 6,508,194 | B2 * | 1/2003 | Myers | B63B 1/121 114/354 |
| 6,595,813 | B1 | 7/2003 | Lekhtman | |
| 6,634,914 | B2 | 10/2003 | Vancil | |
| 6,848,746 | B2 | 2/2005 | Gentry | |
| 8,075,358 | B2 * | 12/2011 | Yesil | B63B 35/73 441/76 |
| 8,438,985 | B2 | 5/2013 | Scadden | |
| 8,641,465 | B2 | 2/2014 | Souter | |
| 8,672,719 | B2 | 3/2014 | Grimes et al. | |
| 9,290,244 | B2 | 3/2016 | Souter | |
| 2007/0249246 | A1 | 10/2007 | Neidert et al. | |
| 2011/0303255 | A1 | 12/2011 | DeLap et al. | |
| 2014/0148071 | A1 | 5/2014 | Souter | |

OTHER PUBLICATIONS

U.S. Appl. No. 12/930,647, Aug. 6, 2013, Final Office Action.
U.S. Appl. No. 12/930,647, Sep. 27, 2013, Notice of Allowance.
U.S. Appl. No. 14/167,438, Jul. 2, 2015, Office Action.
U.S. Appl. No. 14/167,438, mailed Feb. 17, 2016, Notice of Allowance.

* cited by examiner

PLATFORM SUPPORT (32)

PARTIALLY OPENED

PLATFORM SUPPORT (32)

CUT THROUGH VIEW OF SLIDING & HOLDING
PARTIALLY EXTENDED SHOWING STRETCH CORD
ATTACHED TO INSIDE SLIDING & HOLDING TUBE

CUT THROUGH VIEW

CUT THROUGH VIEW

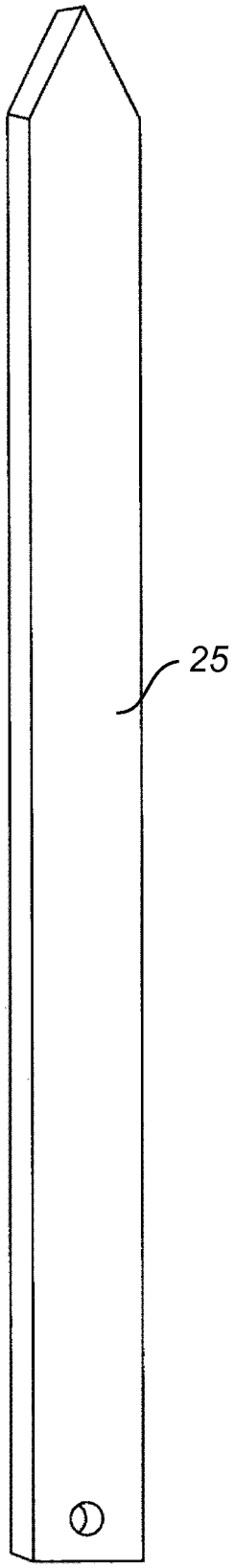
FIG. 18
FIG. 19
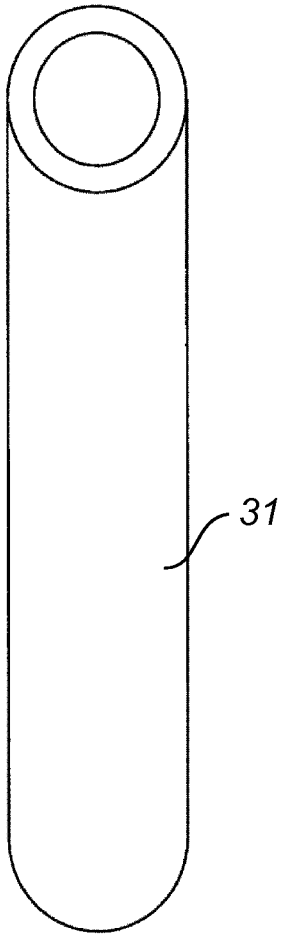

APPARATUS FOR WALKING AND RESTING UPON THE WATER WITH IMPROVED WALKING STABILITY

CROSS-REFERENCE TO RELATED APPLICATIONS

The present application is a continuation-in-part of U.S. patent application Ser. No. 14/167,438, which is a continuation-in-part of U.S. patent application Ser. No. 12/930,647, filed Jan. 13, 2011, now U.S. Pat. No. 8,641,465. The disclosure of each of the foregoing is herein incorporated by reference in its entirety.

BACKGROUND OF THE INVENTION

1. The Field of the Invention

This invention relates to an apparatus used for walking and resting upon the water, specifically an apparatus including a platform that stays attached to pontoons while one is walking upon the water, and allows one to sit and rest after walking upon the water.

2. The Relevant Technology

This apparatus relates to an apparatus allowing a person to walk upon the water. More specifically the invention provides a platform for one to sit and rest on after walking upon the water. The platform may include a ladder inside of it, allowing the user to get into and out of the water with the use of the ladder. Many types of devices have been proposed in the past which allow a person to walk on a body of water, each has various disadvantages.

U.S. Pat. No. 4,034,430 is an example of such a water walking device without a platform attached to it while walking. The pontoons in this invention are fabricated from Styrofoam or other similar buoyant materials and the device is also fitted with transverse stabilizers to maintain a fixed relationship between the individual pontoons. The pontoons slide along the transverse stabilizers to maintain their relative positions and the overall result is a cumbersome device.

U.S. Pat. No. 4,952,184 describes a water walking device also manufactured from a buoyant material such as from rubber or Styrofoam. The user's foot is attached to the top of this device with a foot piece that locks the user's foot to the pontoon. This device also includes rotatable paddles attached to the bottom surface of the pontoon which are allowed to rotate horizontally against the bottom surface of the pontoon.

U.S. Pat. No. 5,080,621 describes a third type of water walking device. This device is manufactured from polyurethane foam or other similar material. It has means for attaching the user's foot in place in the pontoon footwell which includes the use of hook and loop tape or a resilient spring like u-shaped rear ankle support.

U.S. Pat. No. 5,697,822 describes a fourth water walking device that has a pair of buoyant platforms with a pair of sidewalls attached to the top surface of each of the platforms. Removable, inflatable buoyant pontoons are secured to the platforms through flexible sleeves secured to the sidewalls. The pontoons have footwells into which the user inserts his foot, resting the foot on the platform and the foot is secured in place by the addition of the air pressure to the pontoon.

SUMMARY

The present invention employs a number of new approaches for solving the problems that exist in water walking devices. Rather than having the foot held into the footwells, or attached to the top of the pontoons, the footwell may comprise a part of the inflatable pontoons. The footwell may be sealed off at the bottom of the pontoon, keeping the water from entering into the footwell at the bottom of the footwell. The footwell is large enough for a user to insert his or her foot without getting caught up inside the footwell. For example, the user can step freely into and out of the footwell without getting his shoes caught up inside of the footwell.

It is also an advantage that a narrow support board at the bottom of the pontoon gives the pontoon its rigidity, and acts as a keel for the pontoon. This gives the user greater stability and easier handling of the apparatus when walking on the water. The support board may be designed to be light weight and very strong.

In at least some embodiments, the present invention includes a platform attached to the pontoons when walking upon the water. The platform stays attached to the pontoons directly behind the user when the user is walking on water. This allows the user to sit and rest after walking on the water. The platform allows the user to stay out on the water for long periods of time, giving the user a place to sit and relax while fishing. One would get very tired of walking on the water after a long period of time. The platform also gives the apparatus more stability than without the platform. The platform allows the user to sit and paddle when desired, then simply stand up and continue to walk. In some embodiments, a ladder may be included inside the platform of the apparatus. This allows the user to get into and out of the water as desired. The ladder helps the user get back onto the apparatus, specifically if one was to fall off the apparatus. This would be a great advantage if someone was to fall into the water, far out off-shore, in the middle of a lake, or the ocean.

It is yet another advantage of the invention that the scoops that create resistance to the pontoons from going backwards, are attached to the bottom of the pontoons, and go freely over the water when going forward. There are no obstructions extruding from the pontoons that would prevent the pontoons from going smoothly over the water. It is yet another advantage that the scoops can be attached and removed from the apparatus for easy transportation and storage.

Additional features and advantages will be set forth in part in the description that follows, and in part will be apparent from the description, or may be learned by practice of the embodiments disclosed herein. It is to be understood that both the foregoing brief summary and the following detailed description are exemplary and explanatory only and are not restrictive of the embodiments disclosed herein or as claimed.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings, in which:

FIG. 18 shows an upper side view of a support board.

FIG. 19 shows an upper side view of a support tube.

DETAILED DESCRIPTION

The embodiments disclosed herein will now be described by reference to more detailed embodiments, with occasional reference to the accompanying drawings. These embodiments may, however, be embodied in different forms and should not be construed as limited to the embodiments set forth herein.

Figure 1:
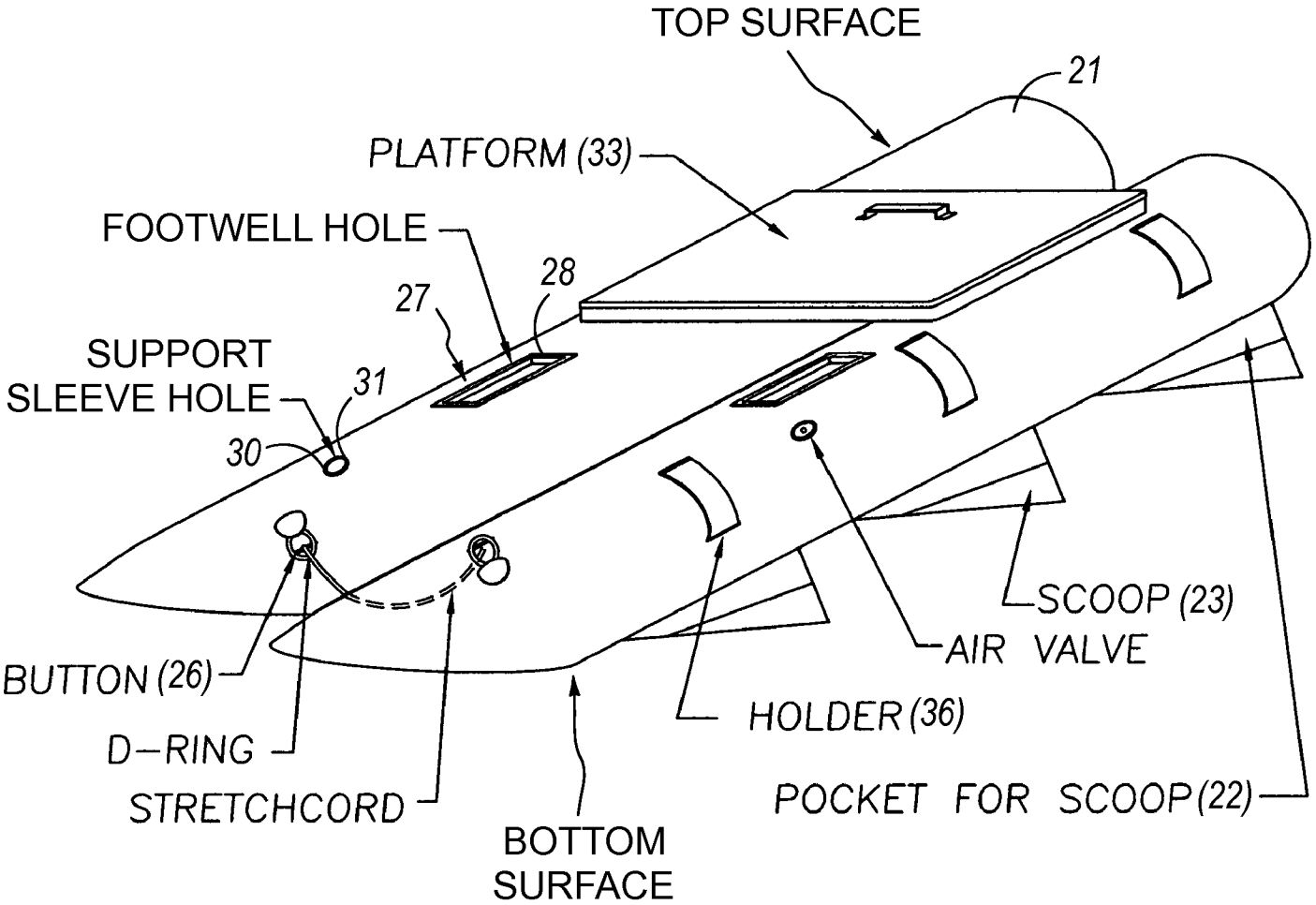
FIG. 1 shows an upper front side view of an apparatus for walking and resting on water. It shows the pontoons, platform, footwells, collars for footwell, air valve, support sleeves, button, stretch cord, holders, pockets for scoops, and scoops.
Figure 2:
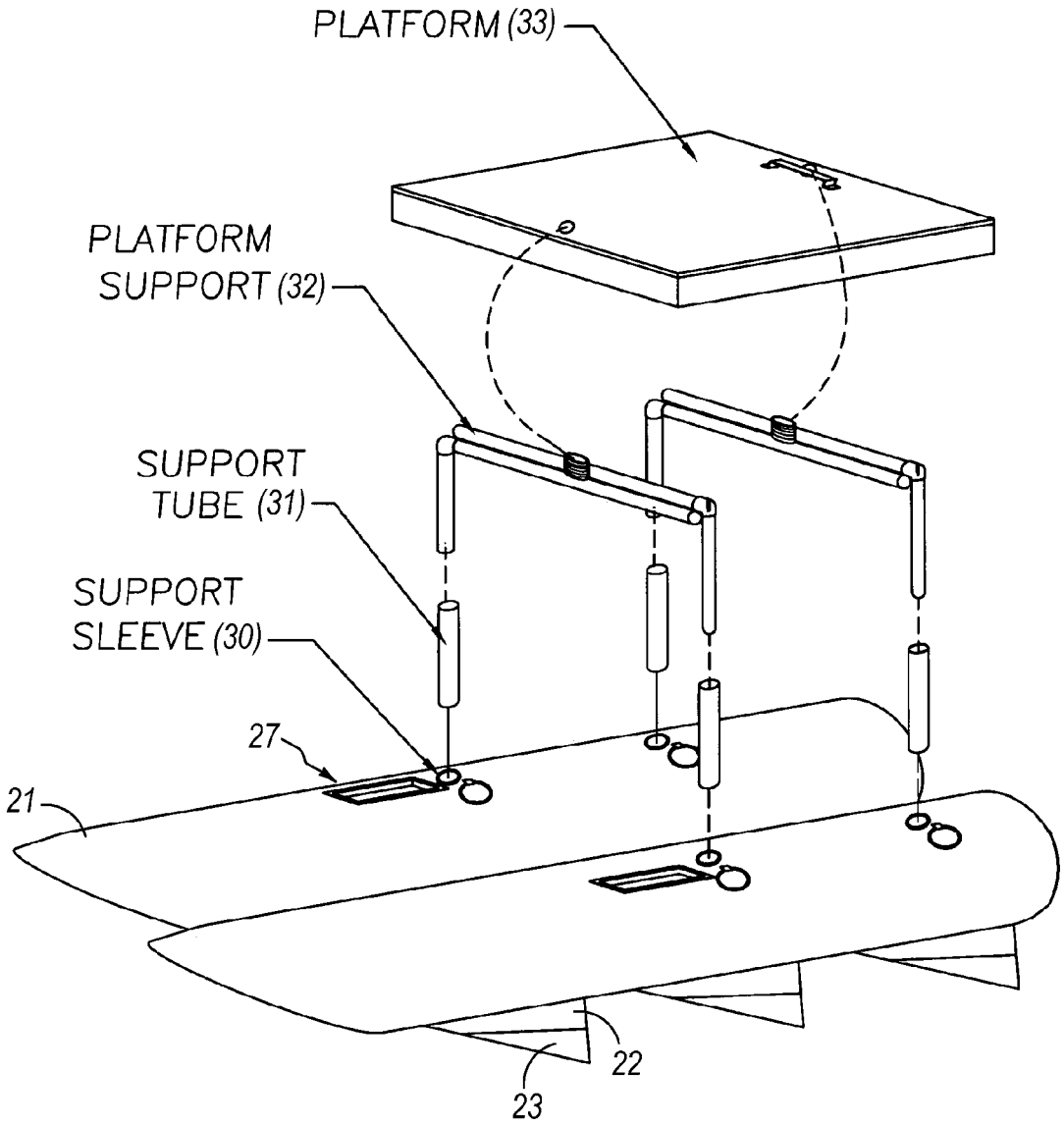
FIG. 2 shows a top side view where the support tubes are inserted into the support sleeves, and how the platform supports are inserted into the support tubes, and where the platform is attached to the necks of the platform supports.

FIG. 1 shows a walking version of an exemplary apparatus. Pontoons 21 are inflatable, lightweight, and compact. Pontoons 21 can be made larger or smaller for different applications. Pontoons 21 can be made out of a high quality reinforced vinyl material. Pontoons 21 can also be made out of a non-reinforced vinyl material. Pontoons 21 may be made by heat sealing vinyl material together in the shape of an elongated inflatable pontoon. Pontoons 21 may have an air valve sealed to them for the purpose of inflating and deflating. The air valve can be of a high quality air valve designed for inflatable boats, or one designed for inflatable toys. Pontoon 21 is shown as having a footwell 27, and support sleeves 30 inside of pontoon 21. Footwell 27 is open at the top and sealed off at the bottom of pontoon 21. Support sleeve 30 is also open at the top and sealed off at bottom of pontoon 21. Pontoons 21 are shown in FIG. 1, and FIG. 2. The typical pontoon 21 is approximately eight feet and six inches long, and is twelve inches in diameter. Pontoon 21 can also be comprised smaller or larger. Pontoon 21 may have several parts heat sealed to it, to be described.

A cover having the same shape as pontoon 21 when the pontoon is inflated may be provided. The cover can be comprised of a fabric material and come in various designs and colors. Where pontoon 21 is formed of reinforced vinyl material, no cover may be needed. Such reinforced vinyl material will not over expand.

Pontoons comprised of a non-reinforced vinyl material may use a cover due to the non-reinforced material having a tendency to expand too much, so that a cover may be provided over the pontoon to keep it from over expanding. A cover also adds protection to pontoons 21 to keep them from being punctured. One could also have extra covers for hunting, and fishing, or highly visible brightly colored ones.

The parts sealed to pontoon 21 may be sewn to the covers at their proper position, such as the pockets 22 for scoops 23, board sleeve 24, holders 36, straps for D-rings, and stretch loops 38. These components would be sewn to a provided cover in the same position where they are sealed to pontoon 21.

Figure 12:
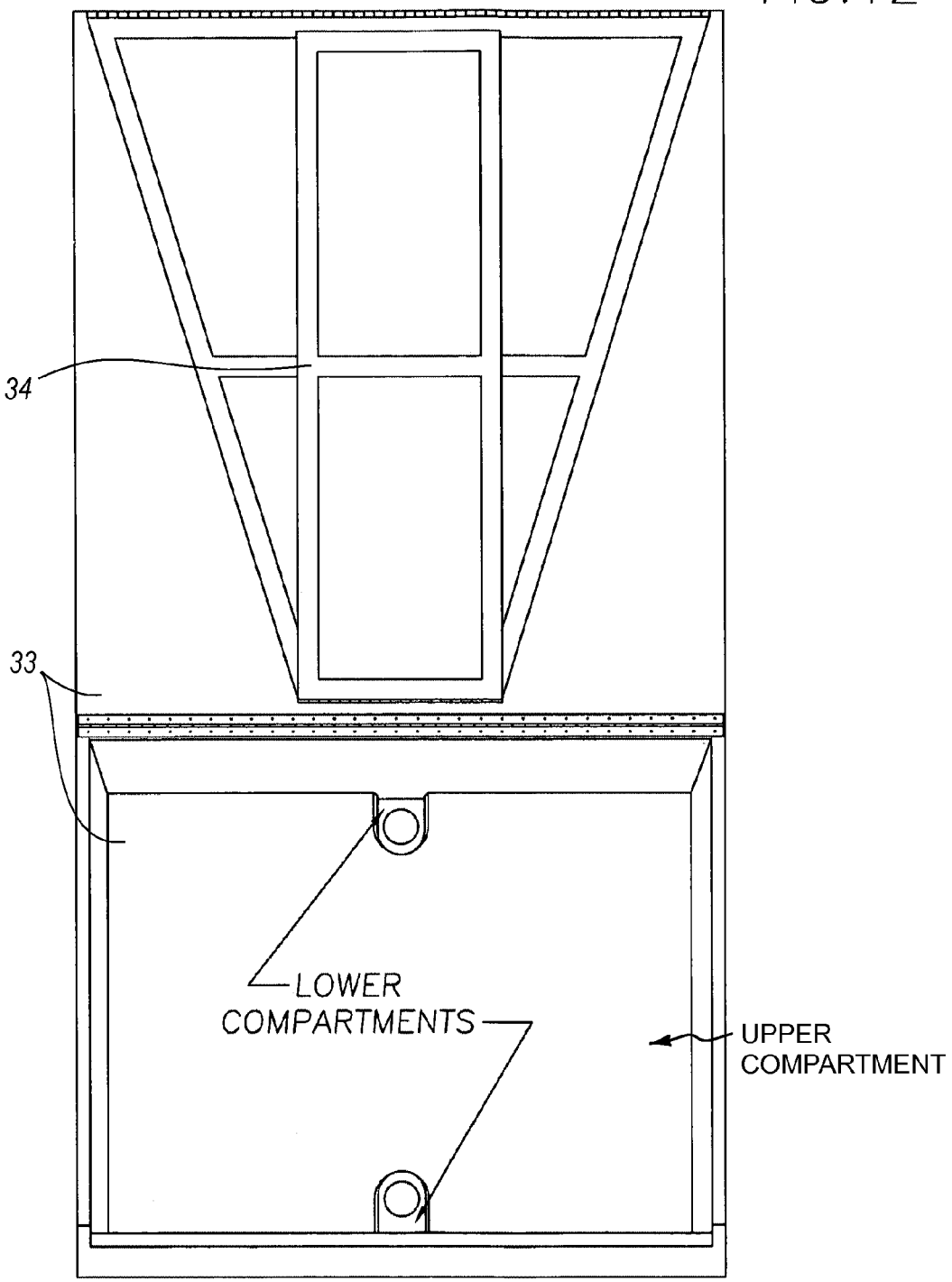
FIG. 12 is an upper rear view of a platform with ladder being folded and attached to the inside of the top section of the platform with the platform open. It also shows the lower compartments inside the bottom portion of the platform, and the hinges for the ladder.

FIG. 2 shows how platform 33 is attached to pontoon 21. Support tubes 31 are inserted into the support sleeves 30 of pontoon 21. The legs of platform supports 32 are then dropped into the support tubes 31. The necks of the platform supports 32 are then inserted up into platform 33. FIG. 12 shows lower compartments of platform 33 where ladder 34 is held inside platform. Caps 35 are then screwed onto necks of platform support 32.

Figure 16:
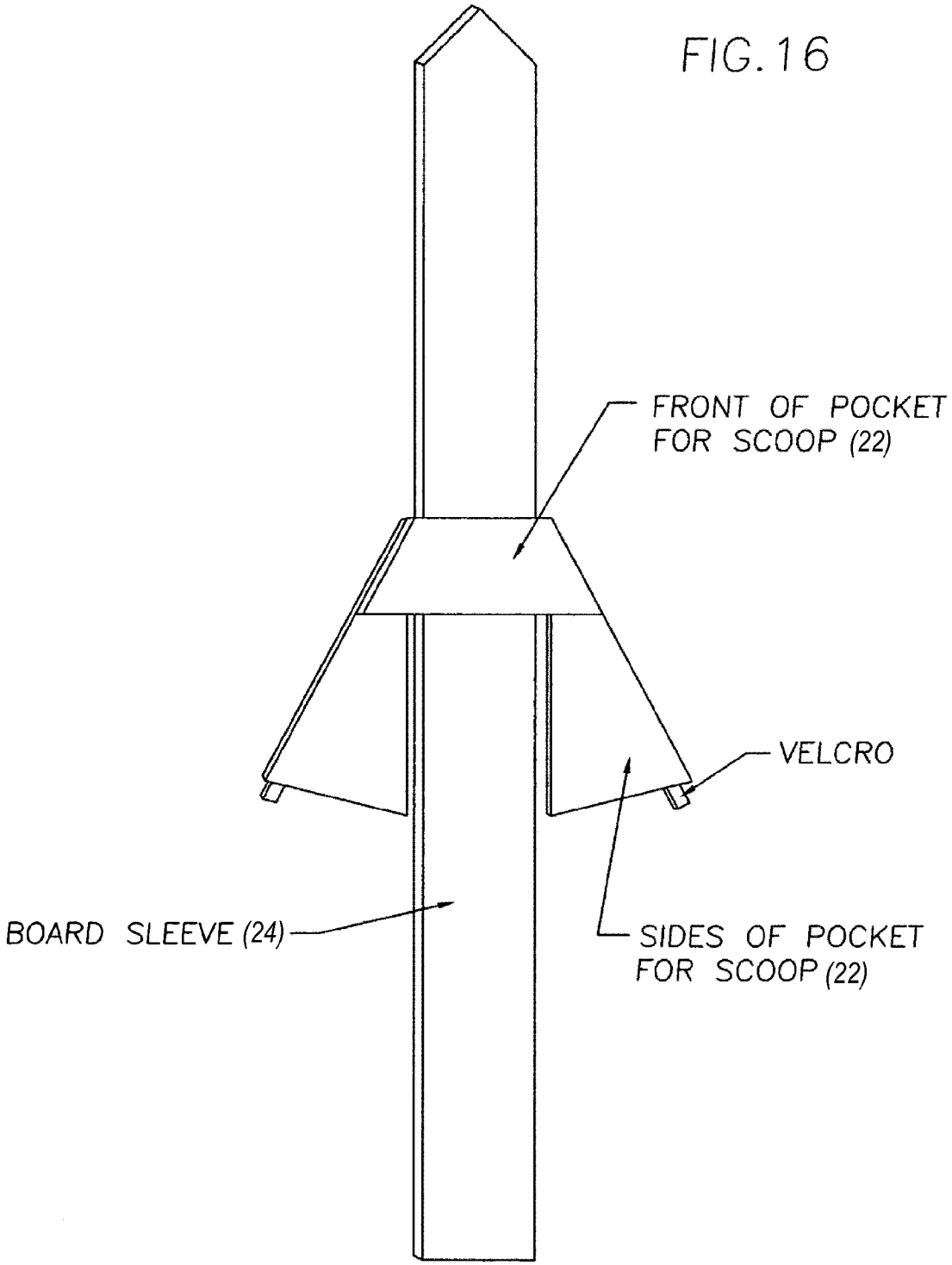
FIG. 16 is a top view of a pocket for a scoop attached to a board sleeve. Velcro is shown attached to the rear side sections of the pocket for the scoop.

FIG. 16 show a top view of a pocket 22 for scoop 23 attached to board sleeve 24. Pocket 22 for scoop 23 is where scoop 23 is temporarily held to the apparatus. Pocket 22 for scoop 23 is sealed to a bottom of board sleeve 24 and pontoon 21. Pocket 22 for scoop 23 has three sections, a front, and two identical side sections. Pocket 22 for scoop 23 can be comprised of a fabric or reinforced vinyl material.

FIG. 16 shows where the front section of pocket 22 for scoop 23 is attached to board sleeve 24. The two front side sections of the pocket 22 for scoop 23 are attached to the sides of the middle section. The outer side sections are then sealed to the bottom of pontoon 21. The outer side sections of pocket 22 for scoop 23 are sealed parallel to pontoon 21 about one to two inches away from the outer edge of board sleeve 24. The very front section of pocket 22 for scoop 23 is sealed to board sleeve 24 and pontoon 21. This creates the pocket 22 for scoop 23. Pocket 22 for scoop 23 is sealed directly to pontoon 21 and board sleeve 24. Pocket 22 for scoop 23 can also be sealed to pontoon 21 in front of and in back of board sleeve 24.

The apparatus may use Velcro (or another releasable fastener) in certain locations on apparatus to be described. Velcro is a two part hook and loop system with hooks on one strip or portion and loops on the other strip or portion. Velcro can temporary hold two pieces of material together, then be pulled apart. Pocket 22 for scoop 23 has Velcro attached to its rear side sections. Scoops 23 have the opposite part of Velcro securely attached to it. Scoop 23 and pocket 22 could also use any other type of fastening device, such as snaps, buttons, stretch cords or a combination of these fasteners.

Figure 15:
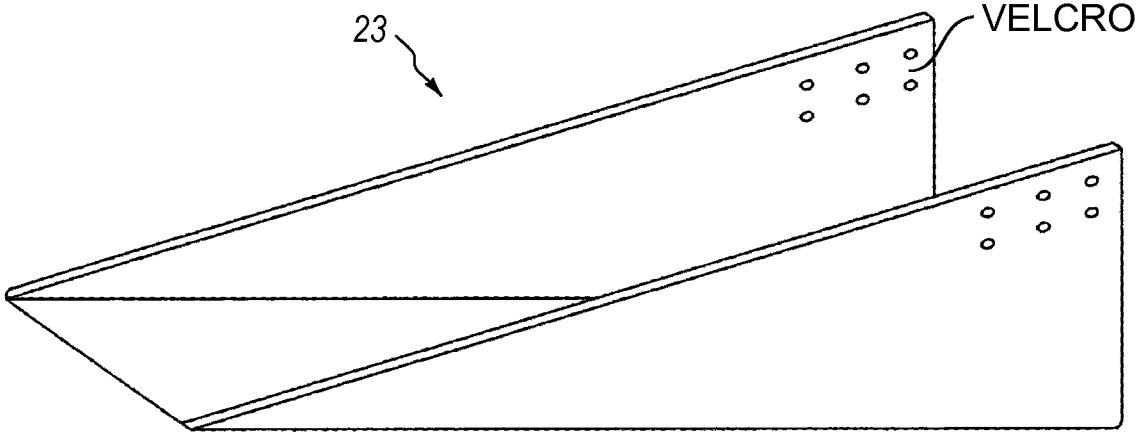
FIG. 15 is an upper side view of a scoop with Velcro attached to an inside of the rear section of the scoop.

FIG. 16 shows pocket 22 with Velcro attached. FIG. 15 shows where Velcro is attached to scoop 23. Velcro is securely attached to rear outer section of pocket 22. FIG. 15 shows where the second part of the Velcro is attached to an inside rear upper section of scoop 22. The Velcro holds scoop 23 into pocket 22. The front end of scoop 23 is held into the front end of pocket 22 by pulling Velcro tightly together.

Scoop 23 can be comprised of plastic shaped by an injection molding process. Scoop 23 can also be comprised of a metal or fiberglass. Scoops 23 pass over water freely when one pushes pontoon 21 forward. Scoops 23 drop into water when pushing opposite pontoon forward. Scoops 23 pass over the water freely when going forward. The sides of scoops 23 come up along the sides of pontoons 21 when walking on land. Scoops 23 automatically drop down into water when needed. This allows one to be able to walk from the land into the water. Scoops 23 are light weight and very durable. The dimensions for scoop 23 and pocket 22 can be many various sizes.

Figure 17:
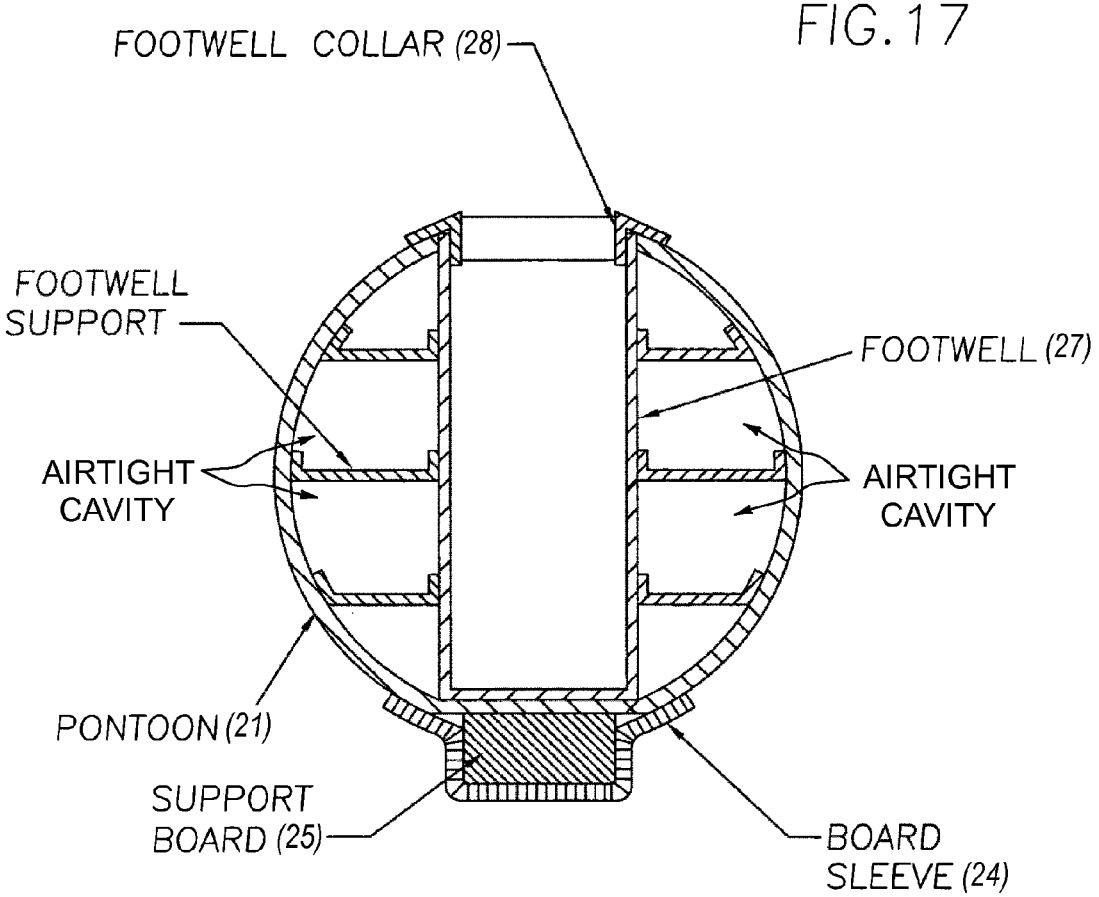
FIG. 17 shows a cross-sectional view through the pontoon, with footwell and footwell supports, footwell collar, board sleeve, and support board.

FIG. 17 shows a cross-sectional view of pontoon 21, footwell 27, collar for footwell 28, and footwell supports. FIG. 18 also shows board sleeve 24 and support board 25. Board sleeve 24 is sealed from front to back at its sides to bottom of pontoon 21. Board sleeve 24 may be open at its rear section to allow support board 25 to enter into board sleeve 24.

Board sleeve 24 allows support board 25 to enter from rear end of board sleeve 24. Support board 25 is inserted into board sleeve 24 before pontoon 21 is fully inflated. Board sleeve 24 holds support board 25 when pontoon 21 is inflated. Board sleeve 24 can be comprised of the same material as pontoon 21. Board sleeve 24 is slightly larger than support board 25. Support board 25 is inserted into board sleeve 24. Board sleeve 24 may also be attached to a cover as described earlier. Support board 25 is centered directly below footwell 27.

FIG. 16 shows a top view of board sleeve 24 along with pocket 22 for scoop 23. Board sleeve 24 is slightly larger than support board 25. This allows for board sleeve 24 to be able to hold support board 25.

FIG. 18 shows a top side view of support board. Support board 25 can be comprised out of wood, plastic, steel, aluminum, fiberglass, or any combination of these materials. Board sleeve 24 and support board 25 can also be longer or shorter. Support board 25 is inserted into board sleeve 24 before pontoons 21 are inflated. Board sleeve 24 is pulled tight against support board 25 when pontoon 21 is fully inflated. Support board 25 is shown as having a hole at its back end for a place to grab onto support board 25 to pull from support sleeve 24.

FIG. 17 shows a cross-sectional view of footwell 27, footwell supports, and collar for footwell 28. Footwell 27 has footwell supports. The footwell supports can be comprised of reinforced vinyl material that is heat sealed from footwell 27 to pontoon 21. Footwell 27 has an opening at its top large enough for one to step into and out of footwell 27 without getting their shoes caught inside footwell 27. Footwell 27 gets longer towards the front bottom, and is able to hold a large size foot (e.g., a US shoe size 15 or even larger). The footwell supports are a part of pontoon 21 and sealed to footwell 27. The footwell supports are sealed from the outer sidewalls of footwell 27 to the inner sidewalls of pontoon 21. Footwell 27 and footwell supports can be comprised of reinforced vinyl material, or a non-reinforced vinyl material.

Figure 14:
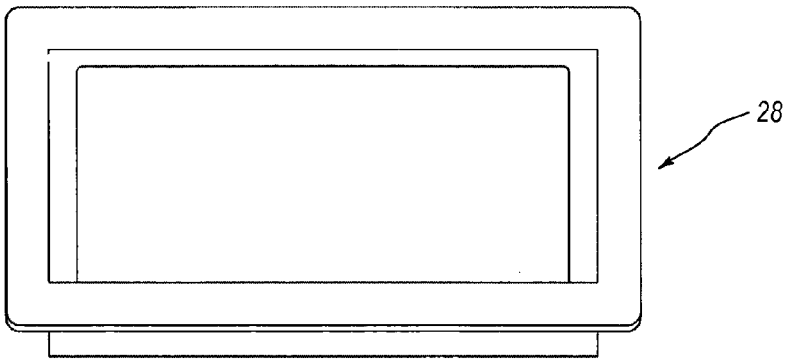
FIG. 14 is an upper side view of a collar for the footwell.

FIG. 14 shows a collar 28 for footwell 27. Collar 28 for footwell 27 attaches from footwell 27 to pontoon 21. Collar 28 for footwell 27 can be comprised of a relatively rigid vinyl or other plastic material formed by an injection molding process.

Footwell 27 may also have the collar 28 already included within footwell 27 by means of an injection molding or other process. This would eliminate the separate collar for footwell 28.

Figure 13:
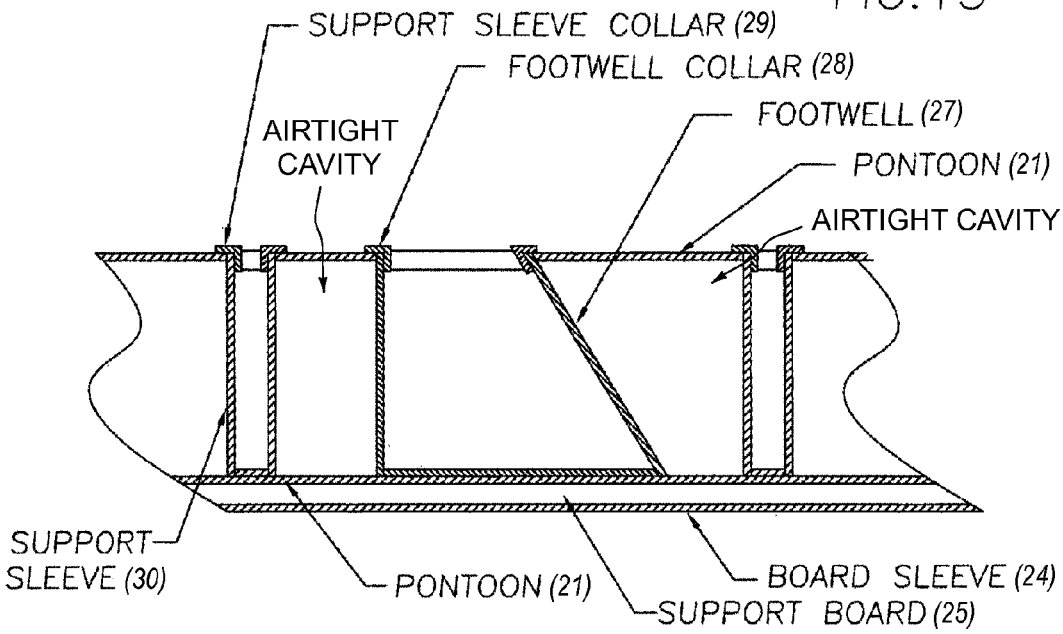
FIG. 13 shows a cross-sectional side view of the pontoon, support sleeves, collars for the support sleeves, footwell, and collar for footwell, board sleeve, and support board.

FIG. 13 shows a cross-sectional side view of pontoon 21, support sleeve 30, collar 29 the for support sleeve, footwell 27, and collar 28 for the footwell. It further shows where support board 25 is held to bottom of pontoon 21. The support sleeves 30 and footwell 27 are sealed off to the inside bottom of pontoon 21.

Support sleeve 30 may also have a collar comprised into it by means of an injection molding or other process, as described earlier with collar 28 for the footwell 27. This may also eliminate the separate collar 29 for support sleeve 30.

Figure 7:
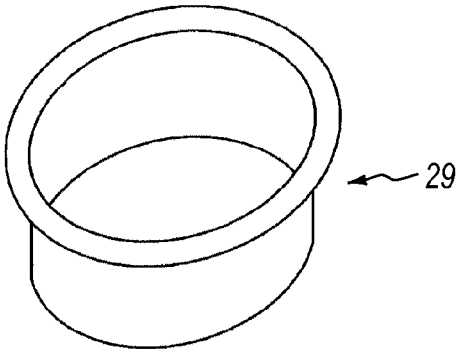
FIG. 7 is an upper side view of a collar for the support sleeve.

FIG. 7 shows collar 29 for support sleeve 30. Collar 29 for support sleeve 30 connects support sleeve 30 to pontoon 21. Collar 29 for support sleeve 30 is sealed in between support sleeve 30 and pontoon 21. Support sleeve 30 is sealed inside bottom of pontoon 21 with collar 29 for support sleeve 30. Support sleeve 30 has collar 29 attached to its bottom before being sealed to bottom of pontoon 21. Collar 29 can also be used to seal the top of support sleeve 30. The collar 29 can be used to seal both the top and bottom of support sleeve.

Support sleeves 30 along with collar 29 are installed at holes in the top of pontoon 21 for the support sleeves 30. Support sleeves 30 are open at their tops and sealed off to inside bottom of pontoon 21.

Support sleeves 30 can also be formed to be sealed off at bottom, with a collar at its top. The support sleeve can be formed to have collar molded to the top and sealed off at bottom by any suitable process. Where the collar is formed integrally with the support sleeve, this may eliminate the separate collar for support sleeve 29 as described earlier.

Figure 8:
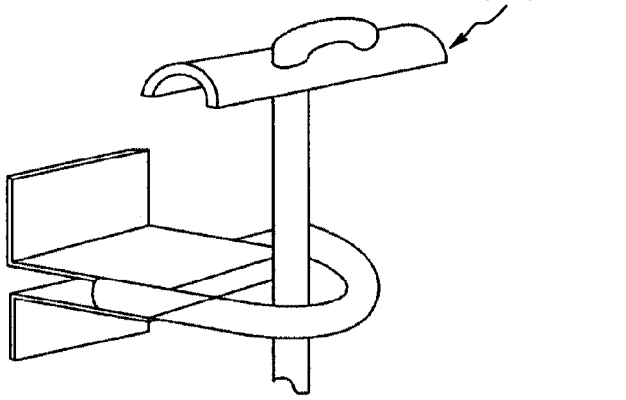
FIG. 8 is an upper front side view of a button attached to a stretch cord after being put through a D-ring.

The apparatus may use stretch cords throughout, as will be described. Pontoons 21 are shown connected together at their front by a stretch cord. FIG. 8 shows how a stretch cord may be attached to button 26. Stretch cord is pushed up through first hole in bottom groove of button 26. Stretch cord is then pushed back through the top of second hole in button 26. A knot is then tied at the end of the stretch cord. The knot on the stretch cord is then pulled into a groove of button 26. The groove holds the knot of the stretch cord into button 26. Button 26 can also be formed with only one hole in the middle of button instead of two holes.

Pontoon 21 may be comprised with D-rings securely attached to its sidewalls. The D-rings may have a piece of reinforced vinyl material sealed over the straight part of the D-ring, to pontoon 21. This secures the D-ring to Pontoon 21. Button 26 and the stretch cord may be held in place on pontoon 21 by the D-ring. Button 26 has a stretch cord attached to it and is put through the D-ring on pontoon 21. Button 26 turns sideways and cannot come out of the D-ring (see FIG. 8). Only with the assistance of the user will button 26 come out of D-ring. The D-rings may be attached at the front and back of the sidewalls of pontoon 21 as shown in FIG. 1.

Pontoons 21 are also connected at their rear by platform supports 32 as shown in FIG. 1 and FIG. 2. These figures show how platform 33 is connected to pontoons 21. Support tubes 31 are inserted into the support sleeves 30 of pontoon 21. Support tubes 31 are strong, rigid, and may be comprised of plastic. The bottom edges of support tubes 31 may be rounded off to prevent puncturing support sleeves 30. The legs of platform support 32 are dropped into the support tubes 31. Support tubes 31 hold legs of platform support 32 inside support tube 31. The legs of platform support 32 are held into and are able to rotate back and forth inside the support tubes 31. Support tubes 31 are slightly larger in diameter than legs of platform support 32. The support tubes 31 rise above pontoon 21 about one inch. This allows platform support 32 to move freely above pontoon 21.

Figure 3:
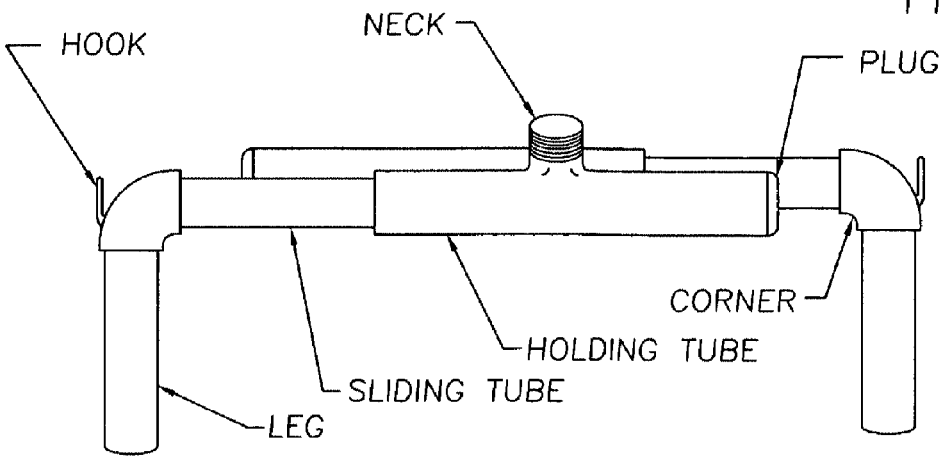
FIG. 3 is an upper side view of the platform support, partially extended, showing the neck, hook, plug, leg, sliding tube, holding tube, and corner, of an embodiment of the present invention.
Figure 4:
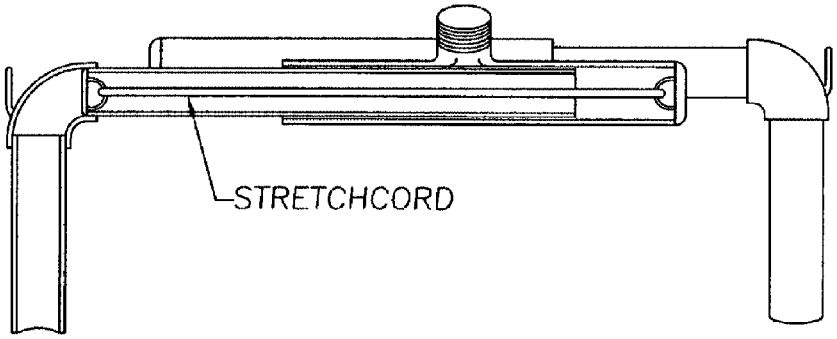
FIG. 4 shows a partial cross-sectional upper side view of the holding and sliding tubes, and of the platform support partially extended, showing a stretch cord inside the sliding and holding tubes of the platform support.

FIG. 2, FIG. 3, and FIG. 4 shows platform support 32. The legs of platform support 32 drop into support tubes 31. The legs of platform support 32 rotate back and forth inside support tube 31. The platform support 32 is very strong and can be comprised of plastic, fiberglass, metal, or any combination of these materials. The corner of platform support 32 is attached to the leg, and the sliding tube of platform support 32. The corner of the platform support rests directly on the top surface of support tube 31. This is where all weight above this point is borne. Support tube 31 and corner of platform support 32 are of the same size where they meet. The support tube 31 keeps leg of platform support 32 centered exactly on top of support tube 31. The corner of platform support 32 rotates smoothly back and forth on the top surface of support tube 31. The corner of platform support 32 can be comprised of plastic, fiberglass, or metal. Corner of platform support 32 is bonded to both the sliding tube, and the leg of platform support 32.

FIG. 3 and FIG. 4 shows the corner having a hook molded to it, the hook holding the stretch loop 38 that is permanently attached to pontoon 21.

Figure 9:
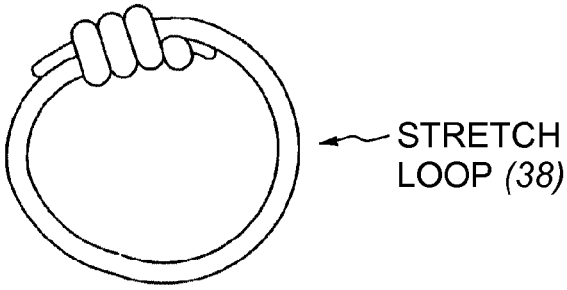
FIG. 9 is an upper view of a stretch loop being held together at ends with wire.

FIG. 9 shows a side view of the stretch loop. Stretch loop 38 can be formed by attaching the two ends of a stretch cord together, creating a loop. Stretch loop 38 can also be comprised of a very strong high quality elastic (e.g., rubber) band. Stretch loops 38 are attached to pontoon 21 by sealing a strap of reinforced vinyl material over a small area of stretch loop 38 to pontoon 21. This same method may be used when attaching the D-rings to pontoon 21 as described earlier. Two stretch loops 38 are used on each hook of the corner of the platform support 32, and attached to pontoon 21 about one inch below opening of support sleeve 30. Stretch loops 38 are attached on opposite sides of the opening of support sleeve 30. This gives equal support on each side, holding down the platform support 32 into the support tubes 31. Stretch loops 38 are stretched up and released into the hooks of the corners. The stretch loops 38 would also be attached to a cover at their proper position as described earlier, where a cover is provided.

FIGS. 3 and 4 shows platform support 32. The holding and sliding tubes of platform support 32 can be comprised out of plastic, fiberglass, or metal. The sliding tubes of platform support 32 slide back and forth inside the holding tube. The holding tube enables the sliding tube to slide in and out of the holding tube very smoothly. The holding and sliding tubes enable platform support 32 to be able to expand and contract. The holding tube is comprised of two tubes molded together with neck of platform support 32 molded in between the two holding tubes at their center. The holding tubes can be formed by an injection molding process for plastic material, or welding or otherwise securing it together for metal applications. The two holding tubes are the same size and parallel with each other with ends apart.

FIGS. 3 and 4 shows platform support 32 partially extended. The neck of platform support 32 is between the holding tubes at its exact center, and is molded or welded onto the holding tubes. The neck of platform support 32 is threaded at its top for cap 35 to be screwed onto neck. The neck is where platform support 32 connects to platform 33.

Platform support 32 uses stretch cords to help pull the platform support 32 together. Stretch cords helps pull platform support 32 back together after being extended. FIG. 3 shows a stretch cord tied at both ends to the plugs inside tubes of platform support 32. FIG. 3 shows where stretch cord is tied to a plug at a closed end of the holding tube, and where it is tied to a plug inside the sliding tube at the opposite end.

Figure 6:
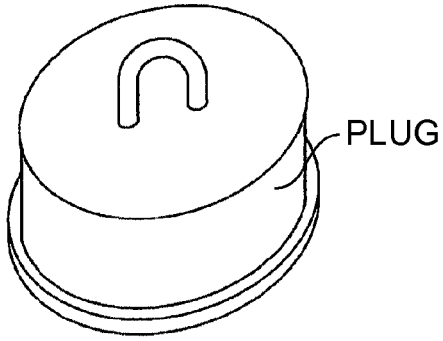
FIG. 6 is an upper side view of a plug for the holding and sliding tubes for the platform support.

FIG. 6 shows an upper side view of a plug. The plugs can be comprised of plastic or metal. The plug has a half ring extending from its bottom side for the purpose of tying the stretch cords to the plugs. The plug also has a collar on an opposite side of the ring on the plug, which stops the plug from entering too far into the sliding tube and the holding tube. The plugs close off the holding tubes, and the sliding tubes at their ends.

Figure 10:
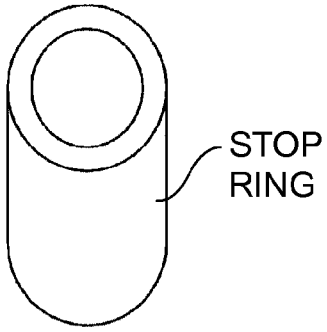
FIG. 10 is an upper view of a stop ring which is attached to the sliding tubes and the holding tubes of the platform support.

FIG. 10 shows an upper side view of a stop ring for platform support 32. The stop ring is sealed to the ends of the holding and sliding tubes of platform support 32.

FIG. 4 shows stop rings inside platform support 32 attached to the holding tubes and sliding tubes. The stop rings keep the holding and sliding tubes from coming all the way apart. The first stop ring is sealed to the outside end of the sliding tube before it is inserted into the holding tube.

The second stop ring is then sealed to the inside opposite end where the plug is sealed to the holding tube. The stop rings are slightly different sizes, although they do butt up to each other which causes the holding and sliding tubes to stop where the stop rings meet at the maximum extension of the holding and sliding tubes.

A rope can also be included within platform support 32, and tied to rings on plugs in the same manner as the stretch cord, and also at the same time as the stretch cord. The rope may be used for the purpose of stopping the sliding tube at the maximum extension length of platform support 32, which could eliminate the stop rings.

FIG. 3 shows where plugs are securely attached to inside ends of the sliding tubes and holding tubes. Two plugs are attached on the outside ends of the sliding tubes, and two plugs are attached on the inside of the opposite ends of the holding tube. The outside circumference of the plugs attached to the sliding tubes are slightly smaller than the inside circumference of the holding tube. This allows the sliding tube to slide smoothly through the holding tube. The sliding tubes slide in and out of the holding tube, enabling platform support 32 to be able expand and contract. The sliding tubes are smaller in diameter than the holding tubes, and this makes it so there are two different sizes of plugs. Sliding tubes will have smaller plugs and the holding tubes will have larger plugs.

FIG. 12 shows lower and upper compartments of platform 33. Two holes are centered at opposite ends in lower compartments of platform 33. The holes in the lower compartments of platform 33 are where the neck of platform support 32 enters up into platform 33. The holes in platform 33 keep platform 33 centered on platform support 32. The compartments inside platform 33 separate neck of platform support 32 and cap 35 from ladder 34. Ladder 34 is above in upper compartment of platform 33. The lower compartments hold and protect neck of platform support 32, and cap 35. Ladder 34 stays up off cap 35 and neck of platform support 32. This allows ladder 34 to go in and out of upper compartment of platform 33 unobstructed.

Figure 5:
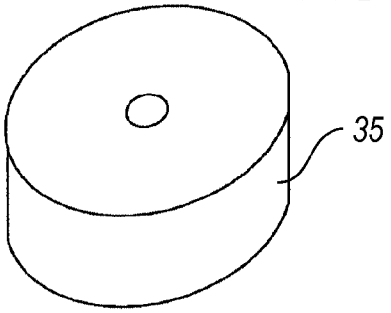
FIG. 5 is an upper side view of a cap which screws onto the neck of the platform support.

FIG. 5 shows cap 35. Cap 35 can be comprised of plastic formed by an injection molding process. Cap 35 can have a strap attached to it by using a screw or rivet. Caps 35 can be strapped into lower compartments of platform 33. The strap can be screwed or riveted from cap 35 into lower compartment of platform 33. A strap helps keep cap 35 from getting lost or falling in the water. Strap could be made out of nylon strapping or plastic. Cap 35 screws tightly onto neck of platform support 32. Cap 35 dose not screw tightly onto platform 33. Neck and cap 35 rotate freely inside lower compartments of platform 33. Cap 35 will not screw tightly onto platform 33, although cap 35 dose screw tightly onto neck of platform support 32. The neck comes up into the hole approximately one inch above the surface of the lower compartment. There is a slight gap between cap 35 and platform 33. The neck is slightly smaller than the holes in the lower compartments of platform 33. This allows for the neck to rotate freely back and forth inside the lower compartment.

FIG. 12 shows platform 33 open with two holes in the lower compartments. The holes at bottom of platform 33 are lined up with support sleeves 30. This keeps platform 33 centered on top of pontoon 21. Platform 33 stays parallel with pontoon 21 at all times. Platform 33 stays parallel with pontoon 21 when walking on water, even while the platform supports 32 rotate thereunder.

Platform 33 gives one a place to sit while not walking on water. It could be very tiresome if one could not sit after walking and standing for long periods of time. Platform 33 makes it easier for one to stay out on the water for longer periods of time. Platform 33 holds ladder 34 inside of its upper compartment. Platform 33 can be comprised from styrofoam, plastic, wood, metal, fiberglass, or any combination of these materials.

FIG. 12 shows a top rear view of ladder 34, and the lower and upper compartments of platform 33. Platform 33 holds ladder 34 inside the compartment of the platform. Ladder 34 is helpful for a user getting into and out of the water. The top hinge of ladder 34 is shown attached to back end of platform 33. Ladder 34 is wider at its top than its bottom portion. The wider section at top of ladder 34 is for the purpose of pushing the pontoons apart, this allows for one to more easily get in between the pontoons 21. Ladder 34 unfolds out of compartment of platform 33, and drops into the water.

Figure 11:
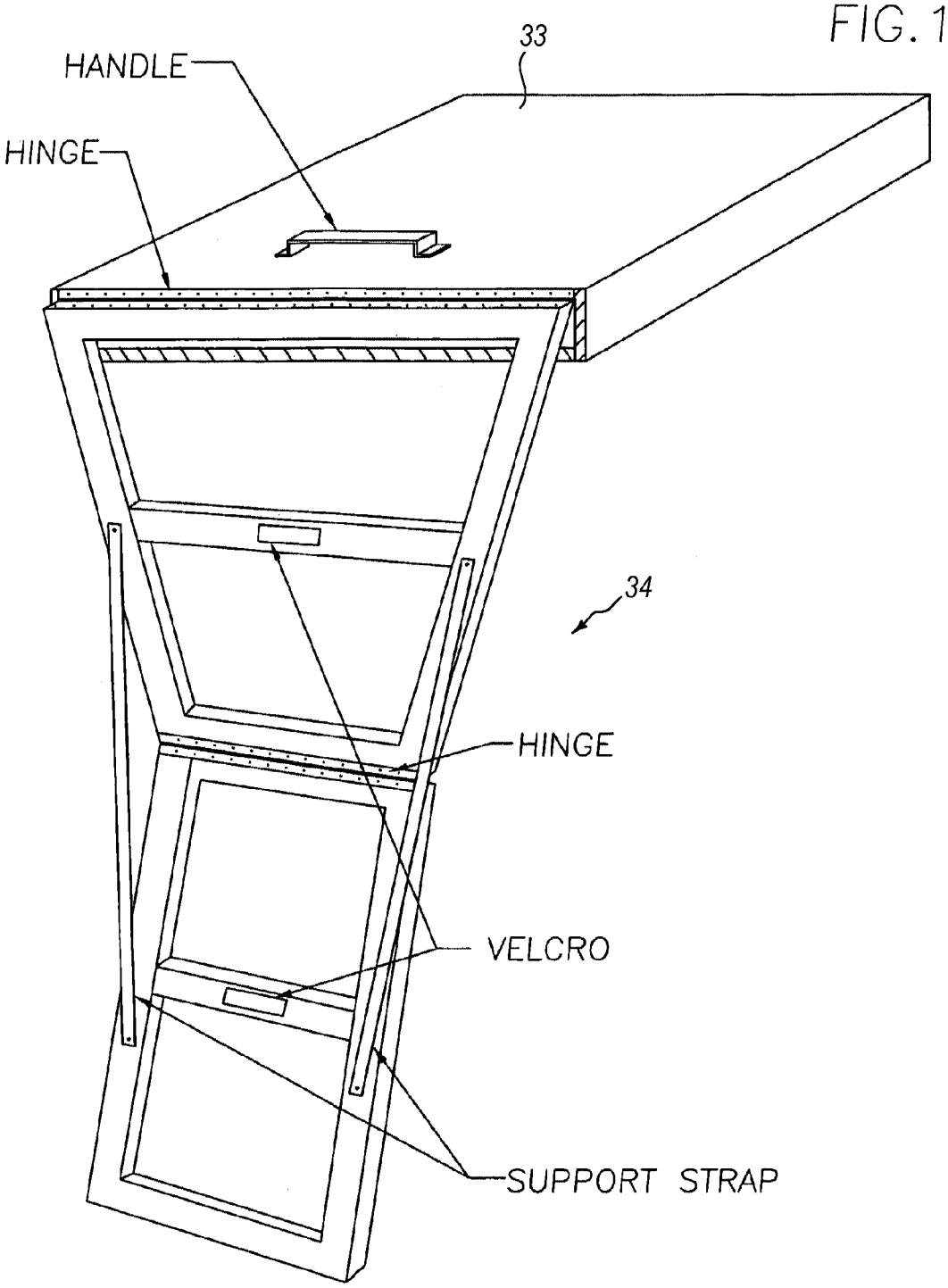
FIG. 11 is an upper rear view of a ladder and platform when the ladder is out of the platform. It shows support straps, Velcro, hinges for the ladder, and a handle on top of the platform.

FIG. 11 shows ladder 34 out of platform 33. The top section of ladder 34 is wider than the bottom section and pushes and holds apart pontoons 21 when ladder 34 is lowered into the water. Pontoons 21 need to be apart for user to get in between them. The lower section of ladder 34 unfolds and drops into the water. The straps and hinges support ladder 34 as shown in FIG. 11. The straps do not let ladder 34 unfold completely. The straps attached to ladder 34 prevent ladder 34 from completely unfolding. FIG. 11 shows how hinges on platform 33 and ladder 34 work. A hinge is at top section of ladder 34 and the rear top side of platform 33. Hinges enables ladder 34 to be folded into and out of platform 33. Hinges enables ladder 34 to hang from a back side of platform 33 into the water. A hinge in the middle of ladder 34 enables the ladder to fold and unfold. This hinge makes ladder 34 twice as long as it otherwise would be, while still fitting within the platform compartment.

FIG. 11 shows ladder 34 when out of platform 33 and with the straps connected from the lower half to the upper half of the ladder 34. The straps can be made from nylon strapping material. Velcro is attached to middle sections of the second and fourth steps of ladder 34. Velcro can be used to hold the two sections of ladder 34 together. A catch could also be used here, holding ladder 34 together for easy removal of ladder 34 from platform 33. The Velcro and catch is for the purpose of holding ladder 34 together when removing ladder 34 from platform 33, making it easier to take ladder out of platform.

FIG. 1 shows platform 33 with a handle on a top section thereof. The handle could be screwed, or riveted to top section of platform 33. The handle can be made out of nylon strapping, reinforced vinyl material, or plastic. The handle is for assisting in lifting the top section of platform 33. The platform 33 could also have a hole here for a place to grab on to, which would act as handle. Platform 33 could also have another handle attached to front side of platform 33. This handle would be used for carrying platform. These handles on the platform 33 could make the apparatus more convenient to use.

FIG. 1 shows holder 36. Holder 36 holds articles such as fishing poles, fishing gear, tools or paddles. Holder 36 can be comprised of a stretch material with vinyl material sewn to ends. The vinyl material is then heat sealed to pontoon 21. Holder 36 can also be comprised of a solid piece of non-reinforced vinyl material. The material of holder 36 may be very strong, pliable, and stretchable.

Holder 36 can hold many different articles making holder 36 very useful. Holder 36 can also be put on horizontally to pontoon 21. Holders 36 can also be attached to a cover. Holder 36 enables one to bring articles that one could not carry in one's hands. Holder 36 could also hold bags that are specially designed for the apparatus. The bags could hold snacks, drinks, tools or anything that would fit in them.

Figure 20B:
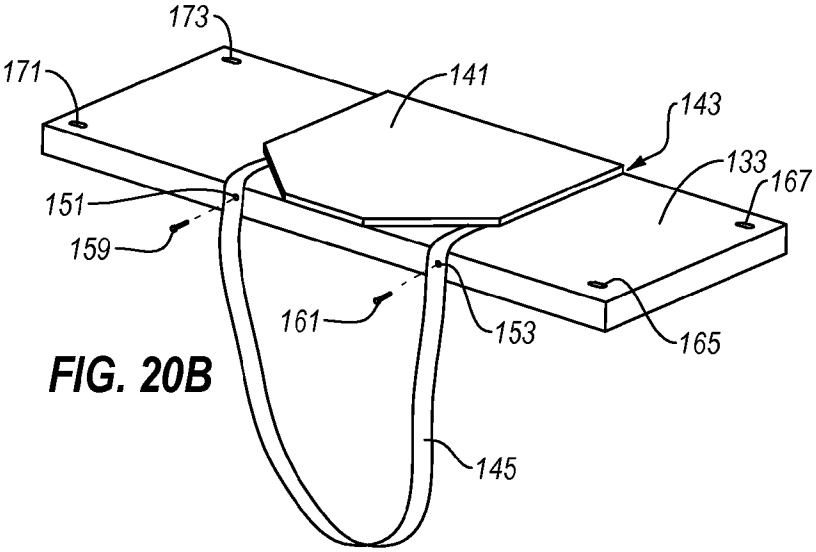
FIG. 20B shows a view of the alternative platform of FIG. 20A with the backrest member folded forward and down.
Figure 20C:
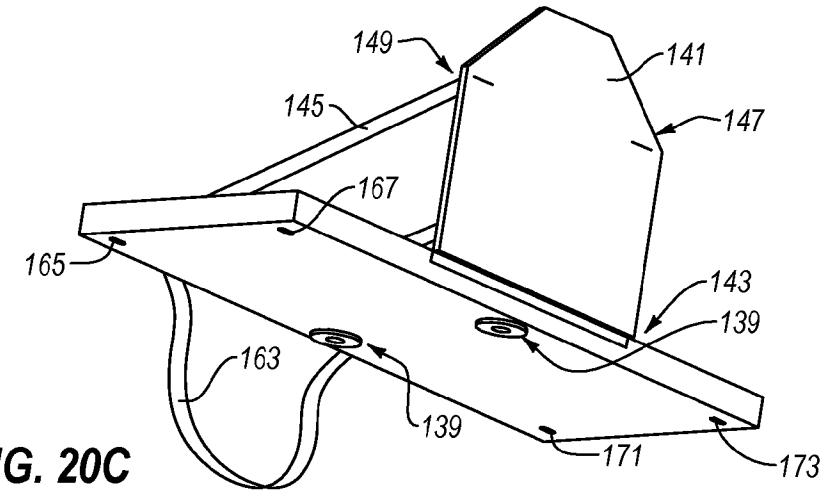
FIG. 20C shows a rear isometric view of the platform of FIG. 20A.
Figure 20A:
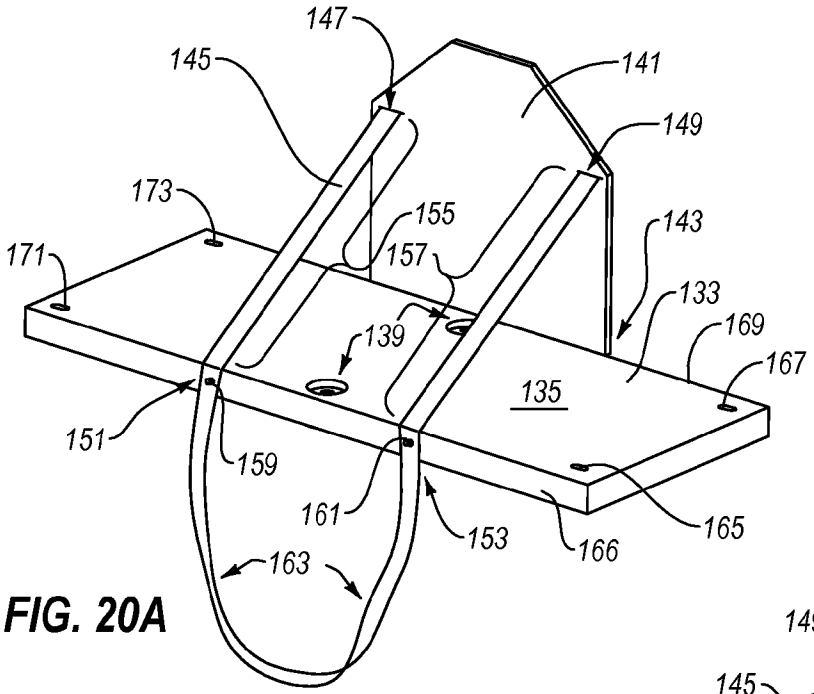
FIG. 20A shows an isometric view of an alternative platform.

FIGS. 20A-21B show an alternative platform that may be used with the previously described configurations (e.g., supported on the previously described platform support, or another platform support). For example, FIG. 20A shows platform 133 that may be coupled to pontoons such as those shown and described in conjunction with FIG. 1 using the platform support 32 described in conjunction with FIG. 2. Platform 133 may not necessarily include any compartments therein, as described in conjunction with FIGS. 11-12. It may include a top face or surface 135 upon which a user may sit, and an opposite bottom face or surface 137. Platform 133 may include holes 139 through bottom surface 137 of platform 133 for receiving the neck of the platform support. As described above, this aids in securing platform 133 to the platform supports, while allowing the platform 133 to ride freely above the platform supports as the neck may rotate freely within the corresponding holes 139 in the bottom 137 of platform 133.

Figure 21B:
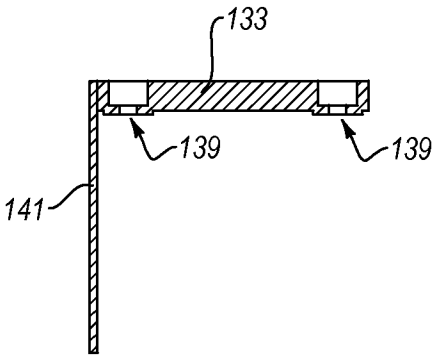
FIG. 21B shows a cross-sectional view through the platform of FIG. 20A.
Figure 21A:
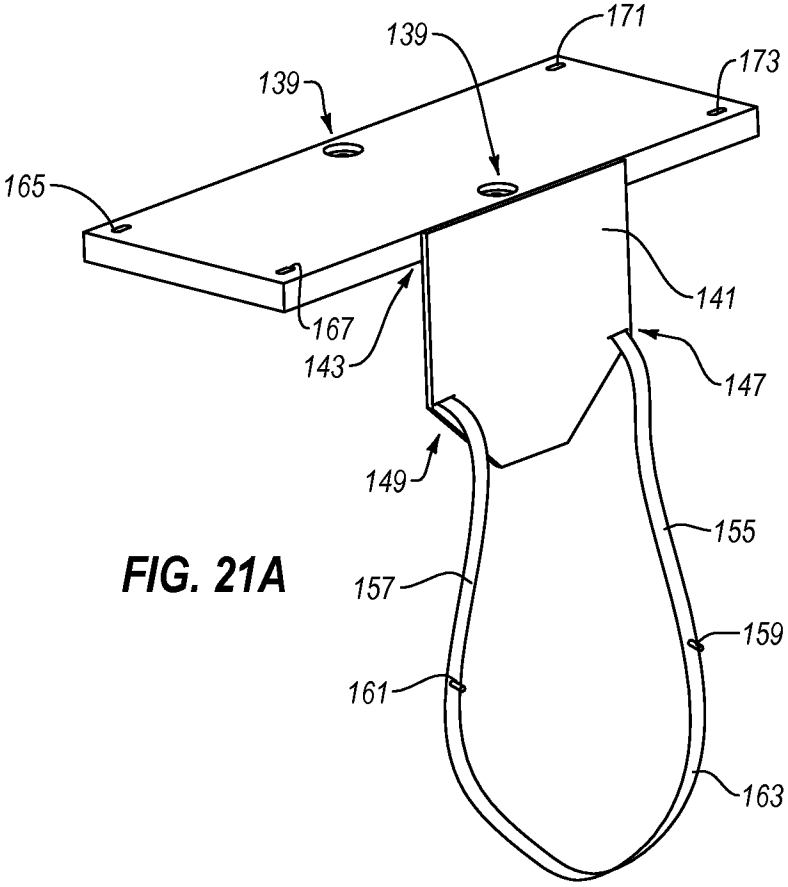
FIG. 21A shows a view of the alternative platform of FIG. 20A with the backrest member folded rearward and down (e.g., into the water), with the strap acting as a ladder step to aid a user in climbing up out of the water onto the platform.

As seen in FIGS. 20A-20C, a backrest member 141 may be provided hingedly attached to a rear 143 of platform 133. As seen, the hinged attachment may be such as to permit forward and rearward rotation of backrest member 141. FIG. 20B shows backrest member 141 rotated forward and down, so as to be generally parallel to and against platform 133. FIG. 21A shows rearward and down rotation, so that the backrest member 141 is generally perpendicular to platform 133. FIGS. 20A and 20C show backrest member 141 in its upright orientation, also generally perpendicular (e.g., about 90° to about 110°) relative to platform 133. It will be apparent that some degree of "recline" (e.g., up to 30°, 20°, or 10° from vertical) may be provided in the upright configuration.

Strap 145 may be provided in conjuction with platform 133 and backrest member 141. Strap 145 may comprise a single, integral piece of strap material (e.g., one strap, rather than two separate straps), which allows the strap to also serve as a ladder step when climbing out of the water onto the platform. Ends 147 and 149 of strap 145 may be attached at opposite lateral sides of the front face of backrest member 141 (FIG. 20A). Strap 145 may form a continuous loop from one end thereof attached to one lateral side of the front face of backrest member 141 (e.g., at 147) to the opposite end attached to an opposite lateral side of the front face of backrest member 141 (e.g., at 149). As seen in FIG. 20A, each end of strap 145 may be latitudinally aligned with a corresponding strap retention recess 151, 153 formed into platform 133 so that strap 145 forms two spaced apart diagonal arm portions 155, 157 on either side of backrest member 141. Portions 155 and 157 are defined between respective ends 147, 149 at one end and elongate locking members (e.g., screws, bolts, etc.) attached to strap 145 and received within aligned strap retention recesses 151 and 153, respectively. As seen in FIG. 20A, the strap 145 may be a single strap, so that portions (e.g., 163) of the strap between elongate locking members 159 and 161 loop around so as to be connected to one another.

It will be apparent that the elongate locking members 159 and 161 are received with corresponding strap retention recesses 151, 153, respectively in order to hold and retain backrest member 141 in at upright orientation, or to at least prevent further rearward rotation relative to platform 133. It will be apparent that with elongate locking members 159, 161 engaged in recesses 151, 153, backrest member 141 may still be rotated forwardly, as seen in FIG. 20B, just not rearwardly, as seen in FIG. 21A.

Strap retention recesses 151, 153 may be formed into the edge face of platform 133, as shown in FIGS. 20A-20B. It will be apparent that alternatively, such recesses may be formed into the top or bottom faces of platform 133, although edge location as shown may be more preferred for convenient access, and so that strap 145 or gravity does not tend to pull elongate locking members 159, 161 out.

As seen in FIG. 21A, when elongate locking members 159, 161 are removed, strap 145 is no longer constrained relative to platform 133, allowing backrest member 141 to rotate rearwardly, so that backrest member 141 hangs downwardly below (e.g., generally perpendicularly) platform member 133. Strap 145, disengaged from recesses 151, 153 now hangs quite low below platform member 133, providing a ladder step (e.g., portion 163) on which a user may step as the user climbs out of the water and onto the platform 133, from the rear. It will be apparent from FIGS. 20A-20B that a with the backrest member rotated forward or not, a user may also climb onto the front of platform 133 using portion 163 as a ladder step, although the step does not hang below platform 133 to the extent it does seen in FIG. 21A, because of its point of attachment to backrest member 141. A user may find it much easier to climb up onto the rear of the platform (FIG. 21A) as opposed to the front of the platform (FIGS. 20A-20B).

Platform 133 may include a mechanism for facilitating attachment of one or more bags or other cargo (e.g., a shotgun) to the top of the platform, out of the water. Hole 165 may be provided through platform 133, adjacent leading front edge 166 of platform 133. A corresponding hole 167 may be provided through platform 133 adjacent trailing rear edge 169. Another pair of corresponding holes 171 and 173 may similarly be provided at the opposite (e.g., left) side of platform 133. As illustrated, holes 165, 167, 171, and 173 may extend entirely through platform 133, and may be elongated, e.g., oval-shaped in cross section. This may facilitate insertion and securement of a bag strap through the holes to secure a bag or other cargo to top surface 135.

FIGS. 22A-22D illustrate another embodiment of an apparatus 200 for walking and resting upon the water, employing features from the other embodiments herein described. For example, apparatus 200 includes two pontoons 221, each including a top and bottom surface. Holes in the top surface are provided for footwells 227. Apparatus 200 includes forward and rearward platform supports 232*a* and 232*b*, similar to those of FIGS. 2-4, but in which no support sleeves, support sleeve holes in the pontoon, or support tubes are needed. Platform supports 232*a* and 232*b* are able to expand and contract in use in the same manner as described relative to the platform supports of FIGS. 2-4, so as to accommodate variable spacing between the pontoons 221 while also connecting the pontoons together (through the platform supports 232*a*, 232*b* and platform 133).

As shown, each platform support 232*a*, 232*b* includes a pair of curved (e.g., C-shaped) saddles 231, which are configured to straddle over the top curved surface of the generally circular curvature of the top surface of the pontoons. As shown, each pontoon may further include laterally disposed pockets 202 into which the ends of the saddles 231 may be secured, to prevent platforms supports 232*a* and 232*b* from sliding either forward or rearward on pontoons 221, as well ask keeping saddles 231 centered atop each pontoon. A pocket 202 may be provided for each end of each saddle 231. As shown, the saddles may be positioned near but behind footwells 227, towards the rear portion of pontoons 221. One or more Velcro straps or other suitable additional fasteners may also be provided, to aid in holding saddle 231 in place relative to pontoon 221. Such Velcro straps may wrap around and over the C-shaped saddle, providing further securance to pontoon 221. In another embodiment, one half of the Velcro material (e.g., hooks) may be attached to the pontoon over where the saddle 231 is to rest, while the other half of the Velcro material (e.g., loops, or vice-versa) may be disposed on the underside of the saddle, so as to press into the first half of the Velcro material, holding the pontoon and saddle together.

Figure 22A:
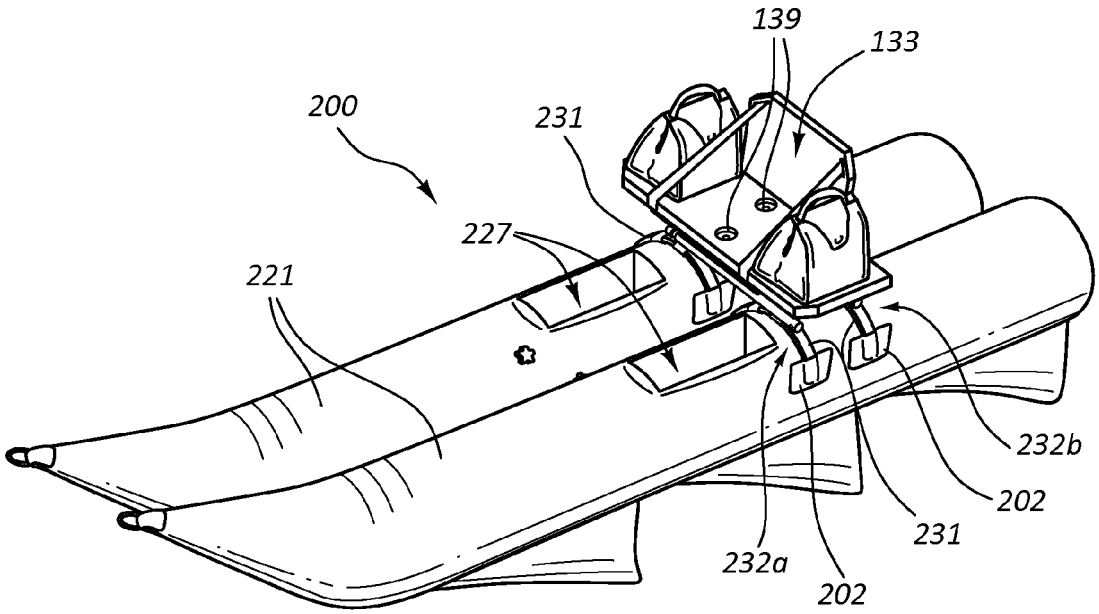
FIG. 22A-22D show another water walking apparatus according to the present invention.
Figure 22B:
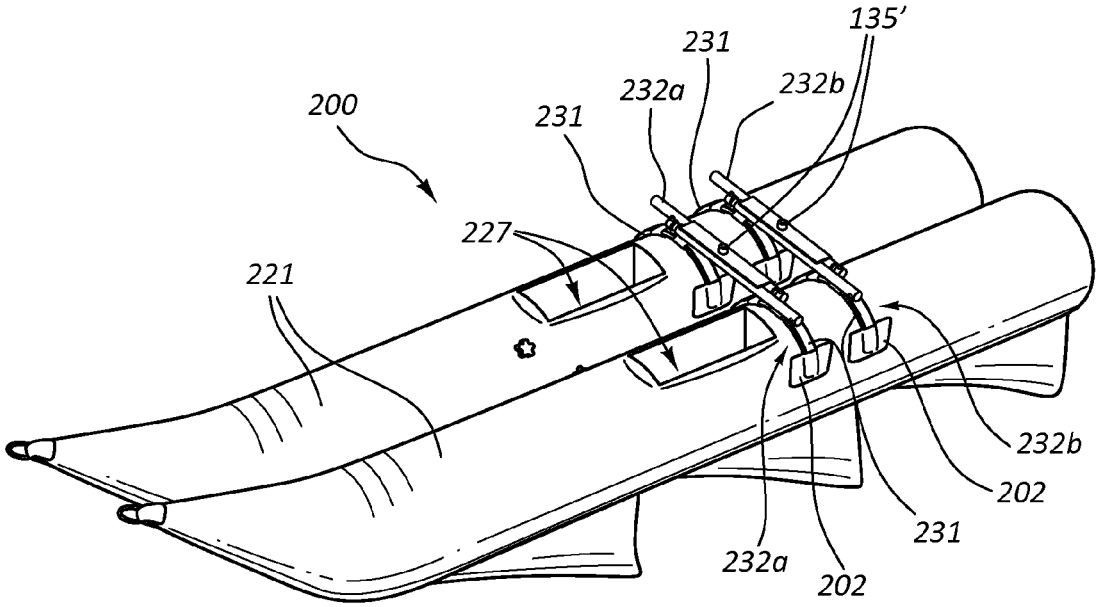
Figure 22C:
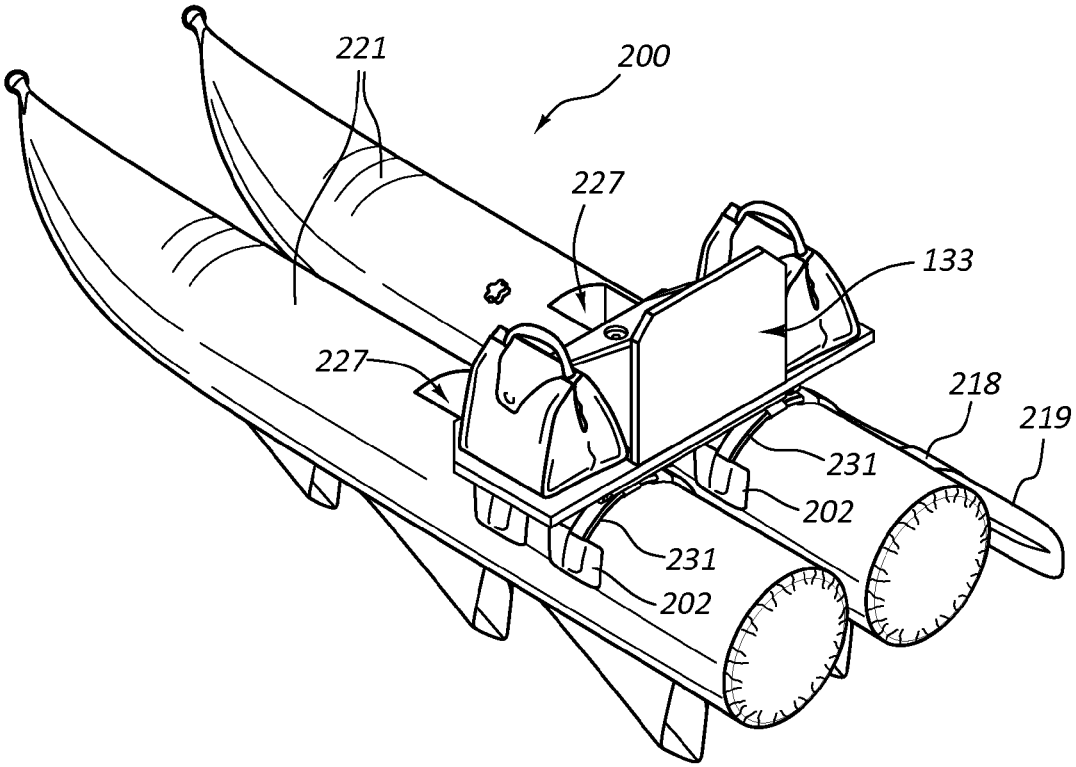
Figure 22D:
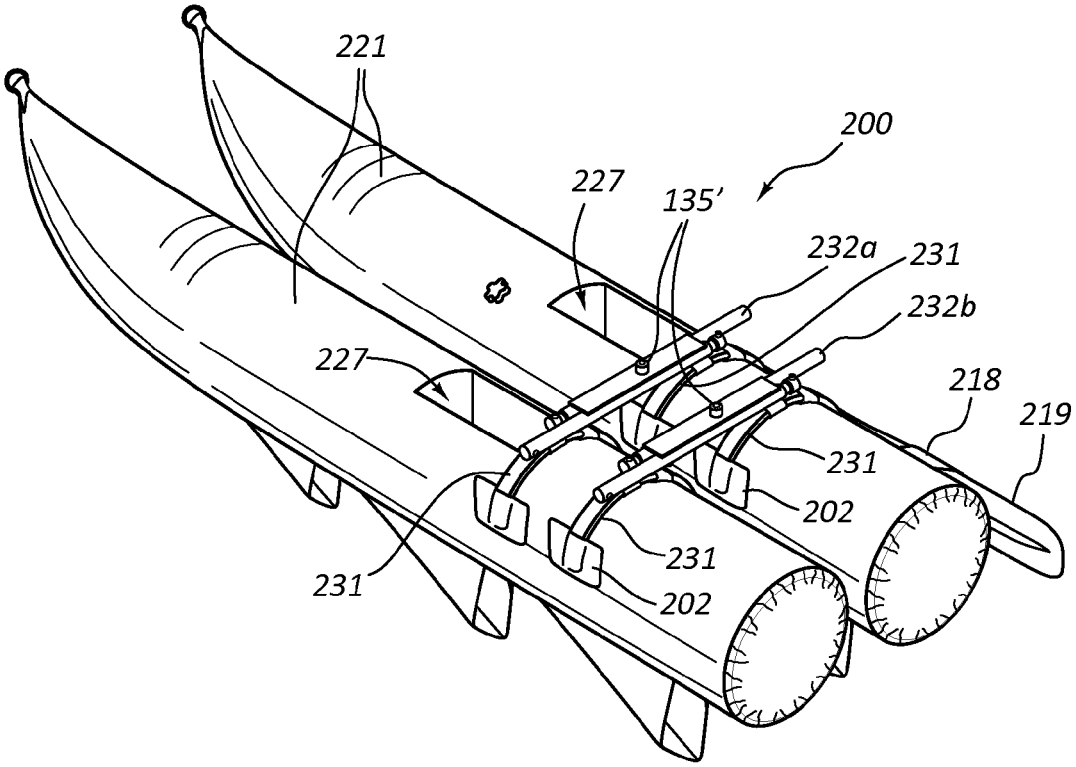
Figure 22E:
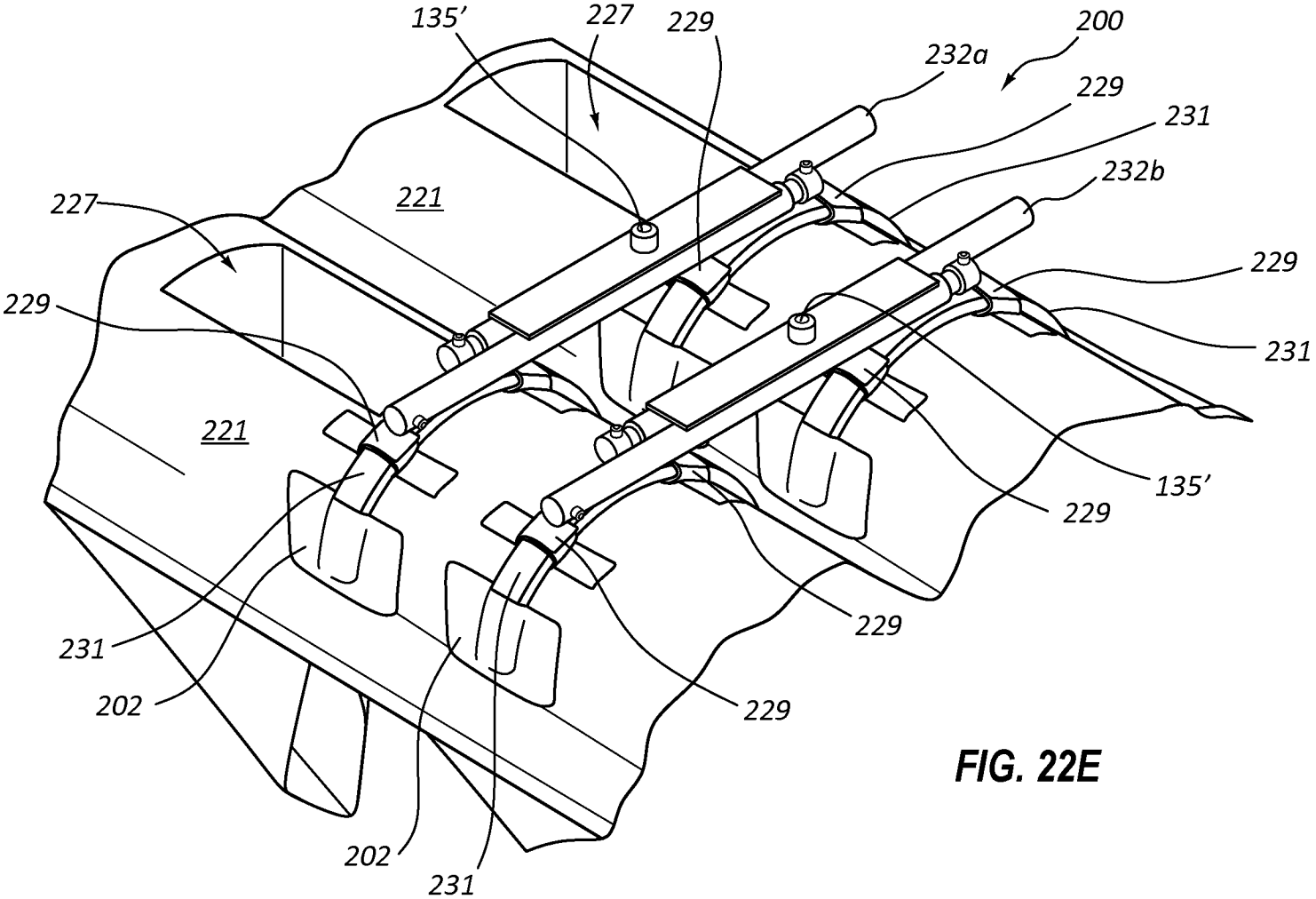
FIG. 22E shows a close up view of a portion of the water walking apparatus of FIGS. 22A-22D, showing a Velcro strap for aiding in retaining the C-shaped saddle in place over the pontoon.

The platform 133 may be positioned over the platform supports 232*a* and 232*b*, with the neck 135' of each platform support received within the corresponding hole 139 of the platform 133. For example, FIGS. 22A and 22C show a platform 133 similar to that of FIGS. 20A-21B. FIGS. 22B and 22D show the platform removed, so as to better see the platform supports and c-shaped saddle thereunder. Platform 133 may similarly include any combination of the features described in conjunction with FIGS. 20A-21B (e.g., including strap 145 to act as a ladder step, etc.).

As seen in FIGS. 22A and 22D, bags or other items may be stored on the lateral ends of platform 133. Such items may be secured by bungee cords, other cords, Velcro straps, etc. FIGS. 22C and 22D also illustrate how one or both pontoons may include sleeves 218 or other mechanisms for securing a paddle 219. For example another sleeve or pocket 218 (e.g., open on one or two ends) may be provided at the forward end of right pontoon 221, for stowing paddle 219.

Figure 23:
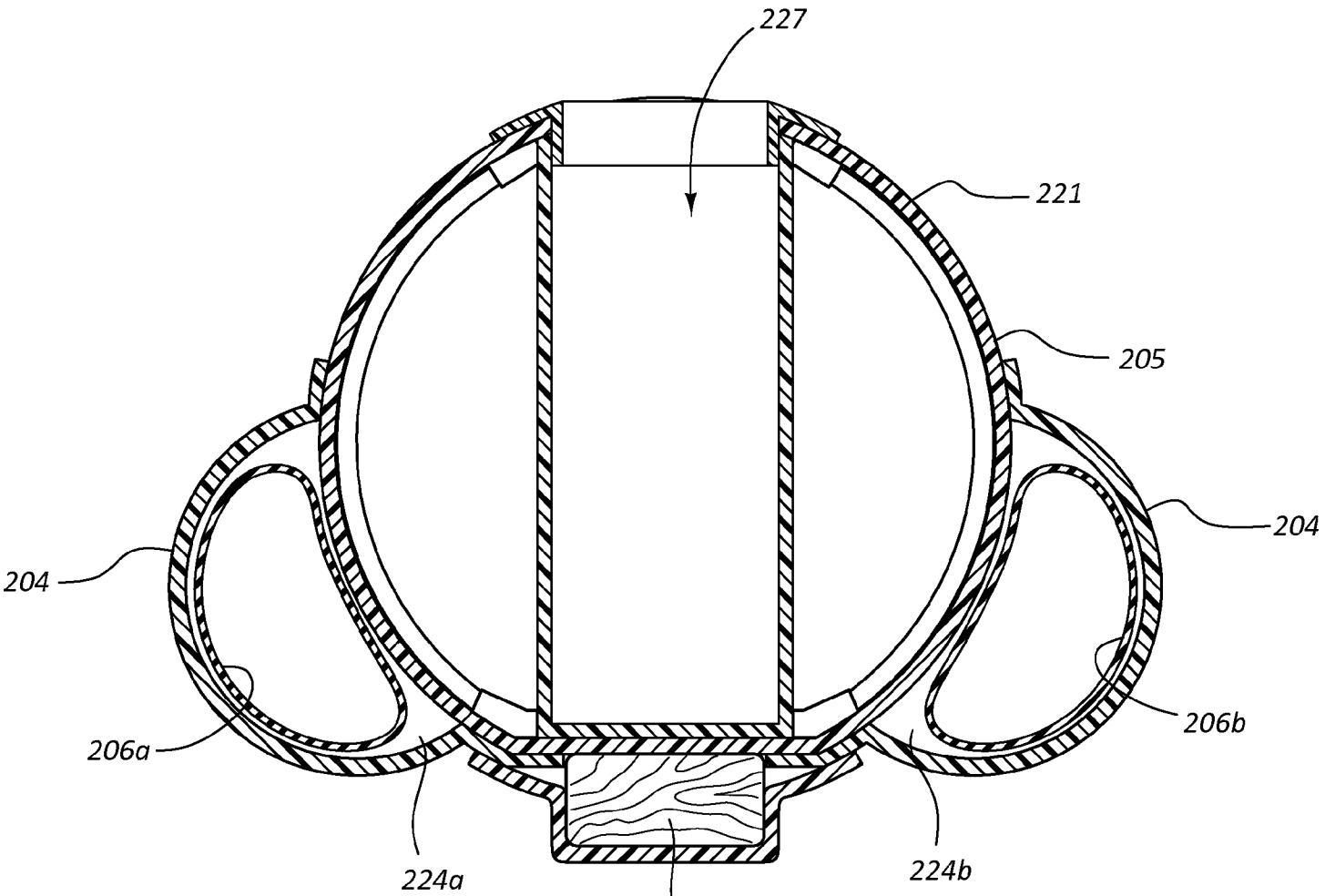
FIG. 23 shows a cross-sectional view through a pontoon including a trilobe configuration for improved stability.

FIG. 23 illustrates how the pontoons may include a trilobe shape in cross-section, rather than the simple circular configuration of FIG. 17. For example, the inventor has observed that where the pontoons are circular or nearly circular, as in FIG. 17, there may be a tendency for the pontoons to rotate about their longitudinal axis, which can result in tipping, or capsizing. FIG. 23 shows pontoons 221 including lateral stabilizing portions 204 on either side of the central pontoon portion 205. Lateral stabilizing portions 204 are shown laterally disposed adjacent to a lower portion of central pontoon portion 205, while the top upper portion of the pontoon maintains a generally circular curvature. The width or lateral stabilizing extension of each lateral stabilizing portion may be at least about 10%, at least about 20%, at least about 25%, or from about 15% to about 75%, or 20% to about 50% of the diameter of the central portion 205. Such a trilobe configuration provides the pontoon 221 with a larger, wider and non-circular base at the location of water contact, stabilizing the pontoons against such unwanted rotation and tipping. As shown in the cross-sectional view of FIG. 23, inflatable inserts 206*a* and 206*b* may be inserted into corresponding pockets 224*a* and 224*b*. One end (e.g., a front end) of such pockets 224*a*, 224*b* may be closed, while the rear end may be open, or selectively openable to allow the user to position inserts 206*a*, 206*b* therein. The construction could be vice-versa (opening at the front), or otherwise (an opening along the top or elsewhere—e.g., similar to the zippered entry of the pontoons shown in FIG. 24). Inserts (e.g., balloons) may be at least partially inflated before insertion, to make their insertion easier. Such lateral stabilizing portions may extend the full length of the pontoon, or only along a portion of the central pontoon portion (e.g., at least about 50% of the length, at least about 30% of the length, at least 25% of the length, e.g., from the footwells back). The rear or other opening of the pockets may be selectively closed (e.g., using Velcro, buckles, a zipper, or other fastener) once the inserts are inserted.

Figure 24:
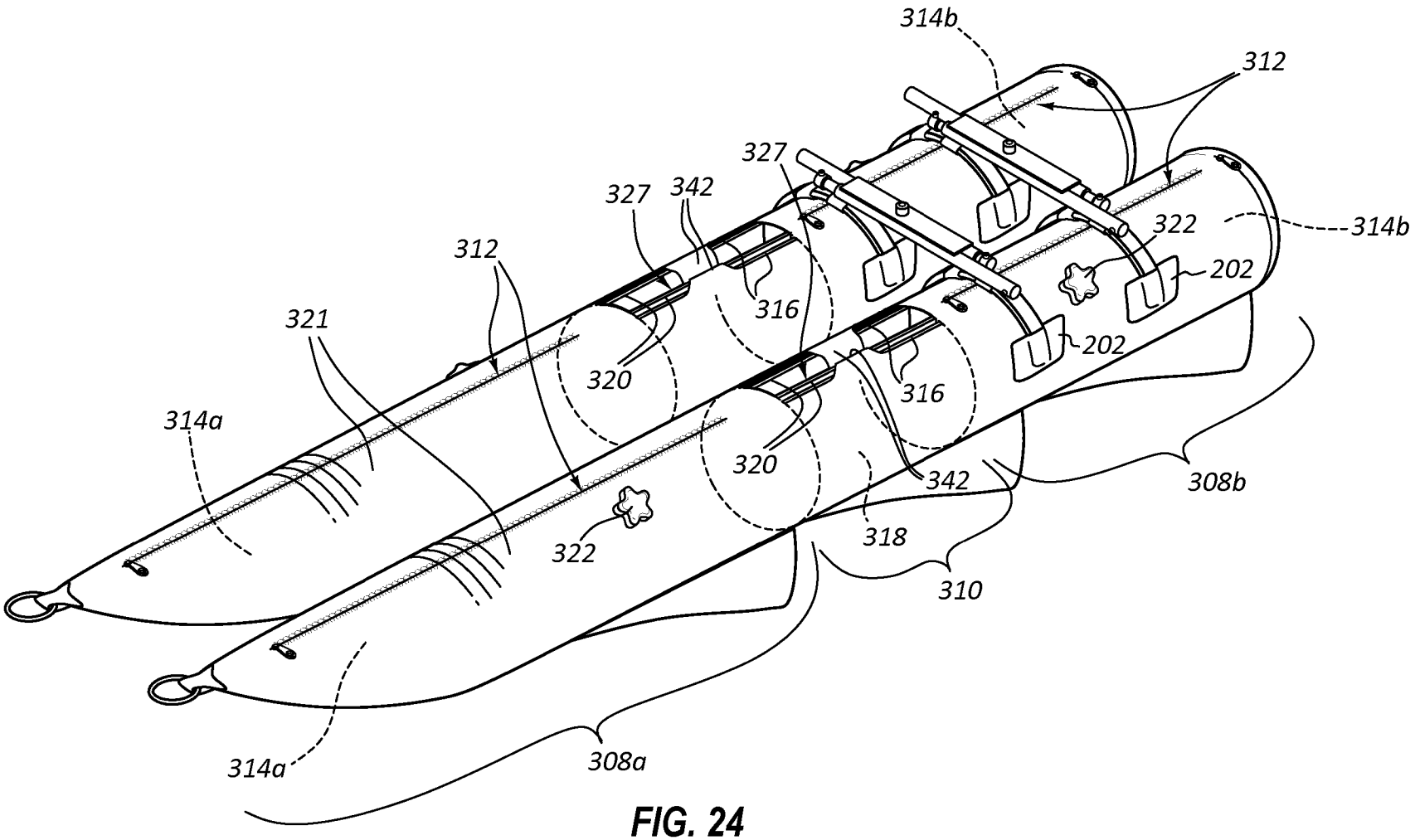
FIG. 24 shows a pontoon configured as a multi-part construction.

In an embodiment, each pontoon may be configured as a multi-part (e.g., 4-part) construction. An example of such pontoons 321 is shown in FIG. 24. Each pontoon 321 includes a forward section 308*a* and a rearward section 308*b*, with footwell section 310 disposed therebetween. Forward and rearward sections 308*a* and 308*b* may be independently inflatable, while footwell section 310 may not be inflatable. For example, longitudinal openings 312 may be provided along a length of the top of forward and rearward sections 308*a*, 308*b* for introducing inflatable inserts 314*a*, 314*b* therein. In another embodiment, openings may be provided in the front end and/or back end, as described in conjunction with the inflatable inserts 206*a*, 206*b* of FIG. 23. As shown, openings 312 may be zippered or otherwise selectively openable and closable (e.g., buttons, buckles, Velcro, other fasteners, etc.).

Footwell section 310 may include a pocket 316 on each lateral side (i.e., left and right) of the footwell 327, adjacent the exterior of the pontoon 321. Such a pocket may be accessible from the top of the footwell 327, allowing the user to insert a stiffener 318 (e.g., plastic sheeting), which is sufficiently flexible to allow it to assume the curvature of the generally circular profile of the pontoon once inserted, but to also provide some shape retention rigidity to portion 310 of pontoon 321. Another pocket 320 may also be provided, inward relative to pocket 316, for stiffening not the exterior surface of the pontoon (which is provided by pocket 316 and stiffener 318), but for stiffening the right and left lateral sides of the footwell 327 itself. This configuration may be best seen in FIG. 25. A stiffener 340 may be inserted into pocket 320, to prevent the left and right sidewalls of the footwell from bulging inward or outward. Stiffener 340 may comprise a rigid material, such as wood or plastic which is sufficiently thick to not significantly bend or flex, maintaining the desired size of the footwell 327. Stiffener 340 may be more rigid than stiffener 318. For example, stiffener 318 may be rollable plastic sheeting (e.g., about ⅛ to ¼ inch thickness), similar to the material of a plastic toboggan sled, which will roll up on itself. Such plastic sheeting material when inserted into pocket 316 may aid the exterior sidewalls of pontoon section 310 to remain in an condition which resembles that of the adjacent inflated sections 308*a*, 308*b* (i.e., the insert holds the exterior wall in the desired outwardly curved circular shape seen in FIG. 25).

Returning to FIG. 24, the front and rear portions 308*a*, 308*b* may include inflation valves. Where inflatable balloon inserts are provided within zippered sections 308*a*, 308*b*, any inflation valve of such balloons may be aligned with inflation ports 322. Where no inflation within footwell section 310 is needed, no inflation port in section 310 may be provided. Sections 308*a* and 308*b* may be sealed (e.g., air-tight) relative to section 310.

Figure 25:
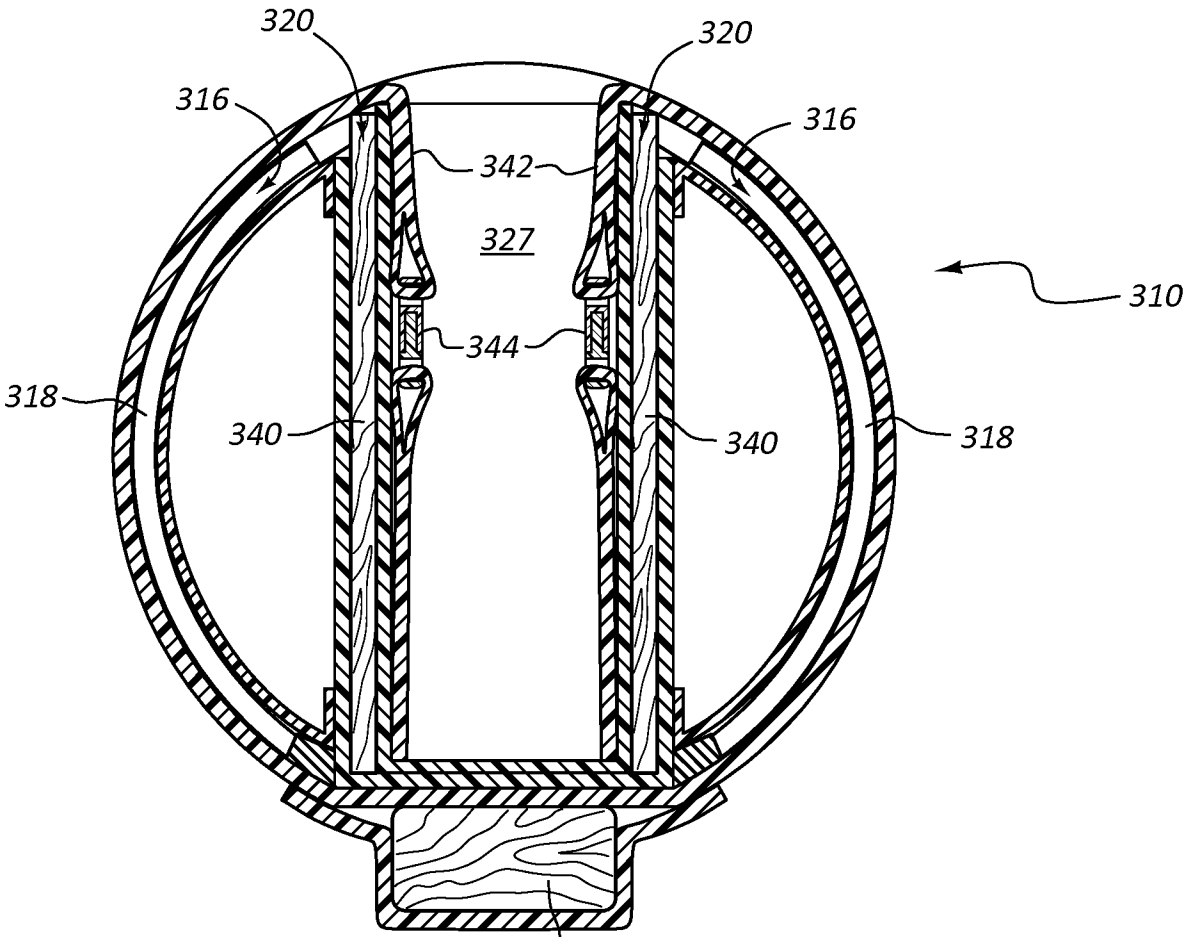
FIG. 25 shows a footwell section of the pontoon of FIG. 24, including pockets into which stiffener inserts may be inserted to stiffen the exterior of the footwell section of the pontoon, and the footwell itself, respectively, as well as a flap which may close over such pockets and inserts.
Figure 26:
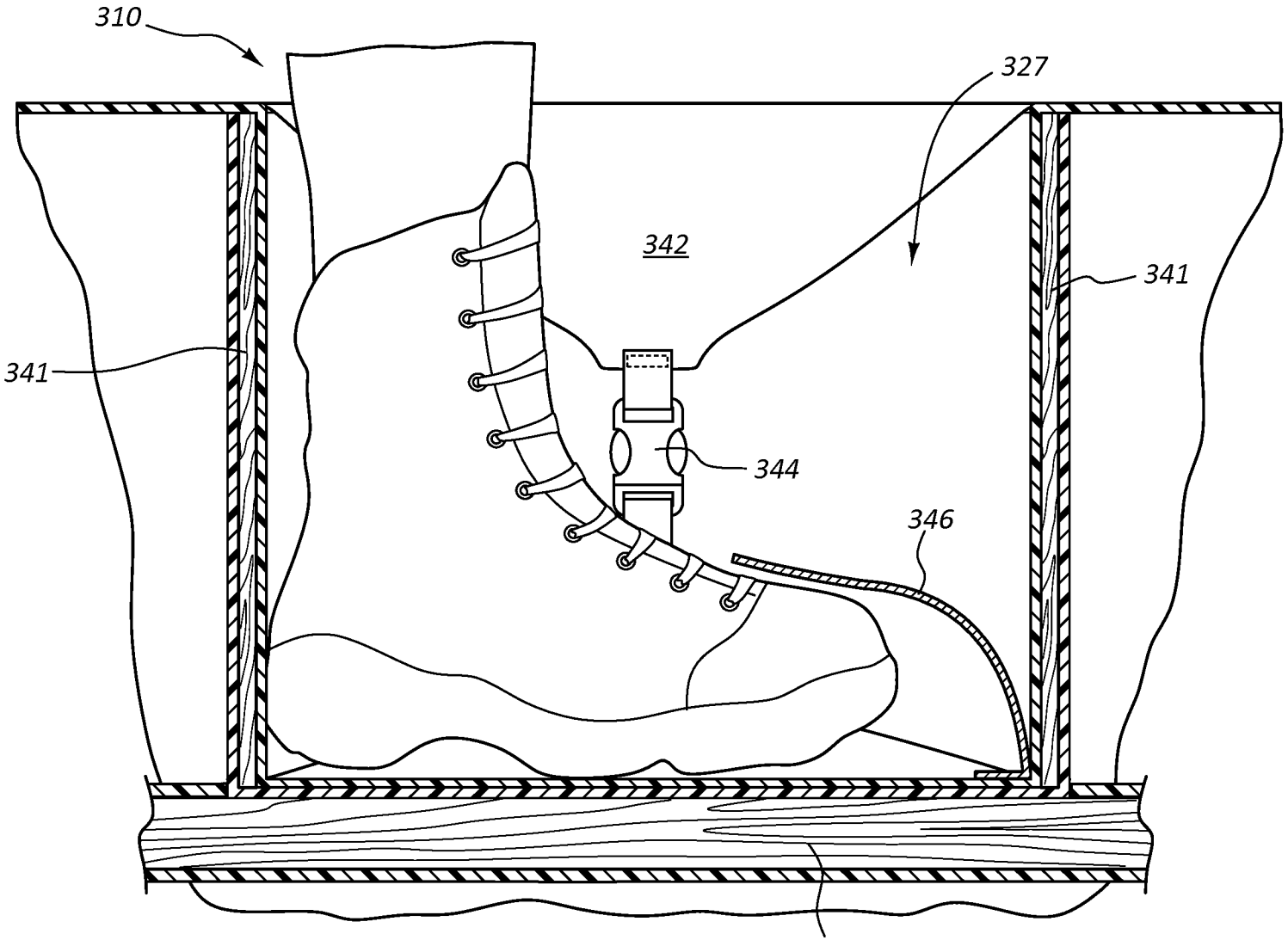
FIG. 26 shows a side view of a user's shoed foot inserted within a footwell, with the foot engaged under a flap of the fabric material from which the apparatus is formed, which flap holds the foot within the footwell while a user walks uphill.

Thus, as seen in FIG. 25, the footwell section 310 may include two pockets on each lateral side. The other lateral side (e.g., left and right) may be similarly configured. The bottom end of each pocket 316 may be sealed at its bottom, where it adjoins the bottom corner of pocket 320 and/or footwell 327. A flap 342 may be provided for closing over one or both pockets 316, 320. FIG. 25 illustrates such a flap 342 which may fold over one or both pockets and any inserted stiffeners, securing them within the respective pockets. Flap 342 is shown as including a buckle fastener 344, which buckles into another half of the buckle, e.g., within the footwell 327. While illustrated with a buckle fastener, it will be appreciated that any other type of fastener (e.g., Velcro, buttons, etc.) may similarly be employed to close flap 342 over one or both pockets. FIG. 26 also shows the flap 342 and buckle fastener 344.

Such an embodiment may not require the horizontal footwell supports seen in FIG. 17, extending between the outer wall of the pontoon and the footwell itself. The desired structural integrity may be provided by the insert 318 and insert 340, even where the pontoon and pockets 320, 316 are formed of a water-resistant fabric-like, drapable material (e.g., vinyl, etc.). As section 310 may not be inflated, the D-shaped space seen in FIG. 25 between pocket 318 and pocket 320 may or may not be air-tight.

Various additional features may also be provided within structures of the water walking apparatus. For example, FIG. 26 shows how a generally horizontal flap of material 346 (or at least including a generally horizontal portion that extends over the toe end of the user's foot) may be provided within footwell 327, at the front end of footwell 327 to aid a user walking up hill, once out of the water (or before entering the water), while wearing the water walker apparatus. While shown with the opposite end of flap 346 attached to the bottom of the footwell 327, it will be appreciated that it could be attached to the front sidewall 341, extending generally horizontally over the toe end of the user's foot. In the illustrated configuration, the left and right sides of flap 346 may be secured to the left and right sidewalls of the footwell 327 (e.g., at a location below flaps 342).

When walking up a hill, it can be difficult for a user to maintain their feet within the footwells, as they pick up their feet (and the pontoons attached thereto—like very large shoes). By providing a flap of material 346 for retaining the user's foot as he or she walks, flap 346 prevents or minimizes any tendency of the user's foot to pull out of footwell 327, where this is not intended. As seen, the front end of the user's foot engages under the flap 346, helping it to remain within the footwell 327, even as the user lifts their foot during walking FIG. 26 also shows how the front and rear ends of footwell section 310 may be sealed from the adjacent front and rear sections 308*a* and 308*b*. For example, a rigid member 341 may be positioned there (e.g., of wood, or plastic—similar to insert 340 or flexible insert 318). In another embodiment, such sealing could be achieved with just the fabric-like drapable material from which much of the device is constructed (e.g., vinyl).

Figure 27B:
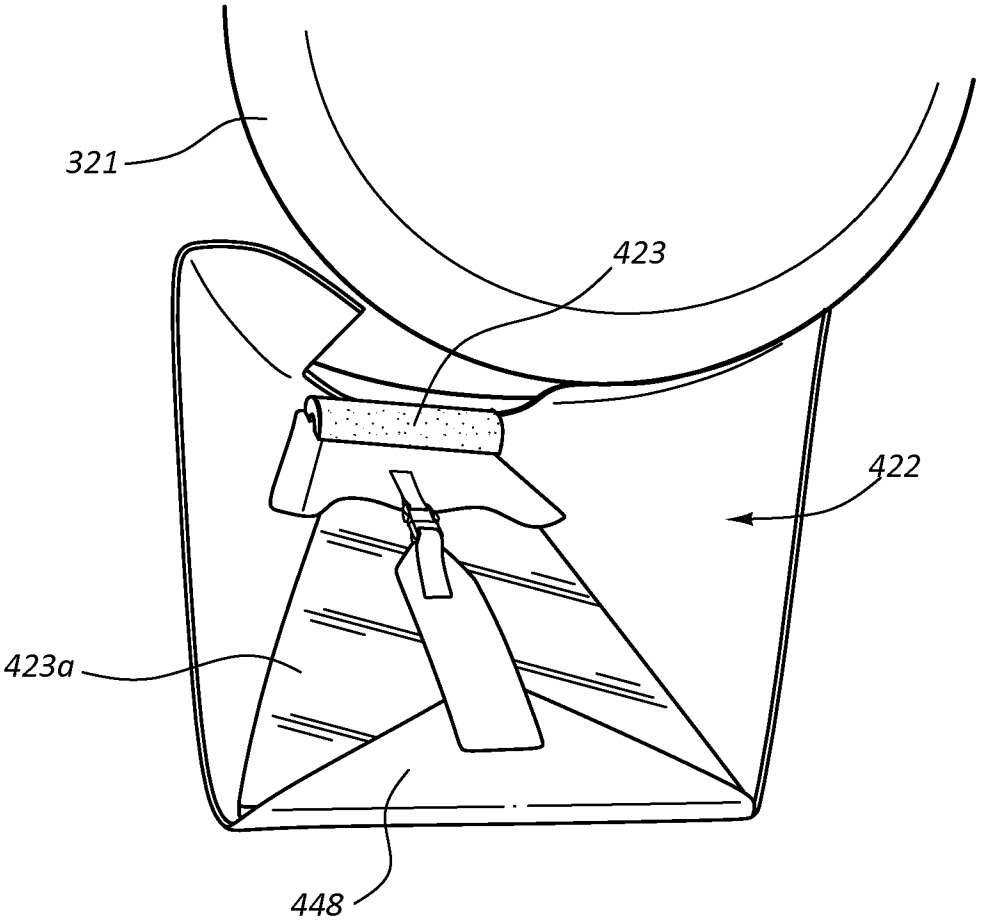
FIG. 27B shows an exemplary scoop pocket under the pontoon, with a foam baffle in the front end thereof, and with a stiffener insert inserted into a pocket in the bottom wall of the scoop pocket.
Figure 27A:
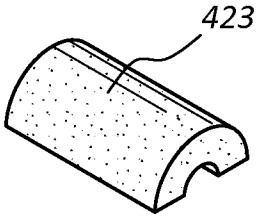
FIG. 27A shows a U-shaped compressible foam baffle that may be disposed within the leading front end of a scoop pocket on the underside of the pontoon.

FIGS. 27A-27B illustrate an alternative scoop baffle 423 alternative to scoop 23 (FIG. 15) for insertion into pocket 422 (e.g., pocket 22) disposed below the pontoon, which resists backwards movement of the pontoon when in the water. As shown, rather than a relatively rigid scoop, such as scoop 23 seen in FIG. 15, a foam baffle 423 may be provided, within the leading front end of the scoop pocket 422. Baffle 423 may be compressible (e.g., comprised of compressible foam), to facilitate easier walking by the user when walking on the ground, before entering the water, or after exiting the water. As seen, baffle 423 may be generally U-shaped, including a hollow interior core section, with the open or hollow section of the U-shape oriented downwards, towards the ground. Baffle 423 may resemble a short in length section (e.g., 4-12 inches) of the foam "pool noodles" often used when playing in a pool, where the noodle has been cut in half lengthwise. The height at the center, under the hollow opening may be about 3 inches or less (e.g., about 1-3 inches). Such a configuration provides a very light weight baffle 423 within the leading front end of pocket 422, which aids pocket 422 in opening, and filling with water if the pontoon is advanced backwards while in the water. Such filling and opening resists further backward movement of the pontoon.

Baffle 423 may be secured within the leading front end of pocket 422 by any suitable mechanism (e.g., glued, otherwise attached, sewn into or otherwise secured into a pocket, etc.). As seen, pockets may be provided within the bottom wall of the scoop pockets 422, for removable insertion of stiffening inserts 423*a* (e.g., rigid boards). Flaps 448 may be provided for closing over such scoop pockets, and the insert. Such flaps 448 may be similar to flap 342, described herein. Such pockets may be open at their rear, allowing insertion of inserts 423 therein, and buckling of flaps 448 over the opening. While FIG. 27B shows insert 423*a* in the pocket, with the face of insert 423*a* still largely exposed, it will be appreciated that in another embodiment, the pocket may cover the face of insert 423*a* once inserted therein. While shown with both foam baffle 423 and inserts 423*a*, it will be appreciated that only one or the other may be provided, if desired.

A configuration including both the compressible foam baffle 423 and stiffening insert 423*a* may facilitate easier walking on land than the scoop 23 of FIG. 15, as the sidewalls of the scoop pocket 422 may simply collapse, so that the user may simply walk on the flat board, rather than the sidewalls being upright (as would be the case for the scoop 23 of FIG. 15 when walking on land).

Such a configuration may be preferred, as it allows the scoop structure to easily collapse when the user is walking on land, as the sidewalls of the scoop pocket may simply be formed of the vinyl material, which easily collapses, and the rigid insert 423*a* is already horizontal, so as to be walked on, without interfering with the user's walking (as would be the case with scoop 23 of FIG. 15). While FIG. 27B shows insert 423*a* in the pocket, with the face of insert 423*a* still largely exposed, it will be appreciated that in another embodiment, the pocket may cover the face of insert 423*a* once inserted therein. For example, the pocket may extend substantially the full length of the bottom wall in which the pocket is formed. Any combination of rigid inserts, pockets, or any of the features from any of the described embodiments may be employed.

Any of the various described vinyl or similar water-resistant materials described above may be employed in forming the pontoons, the flaps, scoop pockets, footwells, lateral stabilizers, etc. In another embodiment, an aramid fabric material (e.g., KEVLAR) may be used, which material is very durable. Where KEVLAR is used, no further reinforcement may be needed (e.g., where vinyl is used, it may be desirable that the vinyl be reinforced with fibers, fabric, etc, providing additional tear resistance, strength, etc. The KEVLAR fabric material may include a vinyl coated surface for water resistance, and/or UV protection.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for walking and resting upon water, the apparatus comprising:

two inflatable pontoons each having a top and bottom surface with respective holes in the top surface for a footwell;

forward and rearward platform supports that expand and contract when in use so as to accommodate variable spacing between the pontoons while connecting the pontoons together;

a platform including a top, and bottom, so as to allow a user to sit on the top of the platform;

wherein each platform support further comprises a neck, the bottom of the platform comprising corresponding holes into which the necks of the platform supports are received so as to hold down and secure the platform to the platform support while allowing the platform to ride freely above the platform supports as each neck rotates freely within the corresponding hole in the bottom of the platform.

2. An apparatus as in claim 1, wherein each pontoon is trilobe shaped in cross-section, so as to include lateral stabilizing portions on either side of a central pontoon portion.

3. An apparatus as in claim 2, wherein the lateral stabilizing portions are laterally disposed adjacent a lower portion of the central pontoon portion.

4. An apparatus as in claim 1, wherein each pontoon includes a forward section, a rearward section, and a footwell section disposed therebetween, the forward and rearward sections being independently inflatable.

5. An apparatus as in claim 4, wherein each pontoon includes a longitudinal opening along a length of a top of the forward and rearward sections for introduction of an inflatable balloon into the respective forward and rearward sections of the pontoon.

6. An apparatus as in claim 5, wherein the longitudinal openings comprise zippered openings along the top of the forward and rearward sections.

7. An apparatus as in claim 4, wherein the footwell section between the forward and rearward sections is not itself inflatable.

8. An apparatus as in claim 4, wherein the footwell section includes a pocket disposed between an exterior wall of the footwell section of the pontoon, which pocket is open at the top surface of the pontoon, is closed at a bottom end, into which pocket a stiffener may be inserted, the footwell section further comprising a flap configured to fold over a stiffener inserted into the pocket.

9. An apparatus as in claim 1, wherein each footwell is open at the top surface of the pontoon, is closed at a bottom side, a front side, and a rear side of the footwell, and includes a pocket on each lateral side of the footwell, between the front and rear sides into which pocket a stiffener may be inserted, each footwell further comprising a flap configured to fold over a stiffener inserted into the pocket.

10. An apparatus as in claim 9, wherein the flap further comprises a fastener configured to secure the flap in a closed position over the pocket and an inserted stiffener.

11. An apparatus as in claim 1, wherein each pontoon further comprises one or more scoop pockets disposed on the bottom surface thereof, configured to fill with water upon rearward movement of the pontoon within the water, so as to resist further rearward movement of the pontoon, each scoop pocket including a compressible foam baffle disposed within a leading front end thereof.

12. An apparatus as in claim 1, wherein each scoop pocket includes left and right lateral sidewalls and a bottom wall, the bottom wall including a pocket formed therein into which a stiffener can be inserted so as to aid the scoop pocket in maintaining an open configuration.

13. An apparatus as in claim 1, wherein the platform supports each include a pair of C-shaped saddles for straddling each of the pontoons, so as to secure the platform support to the pontoons.

* * * * *